US009992587B2

(12) United States Patent
Farmani et al.

(10) Patent No.: US 9,992,587 B2
(45) Date of Patent: Jun. 5, 2018

(54) BINAURAL HEARING SYSTEM CONFIGURED TO LOCALIZE A SOUND SOURCE

(71) Applicant: Oticon A/S, Smørum (DK)

(72) Inventors: Mojtaba Farmani, Smørum (DK); Michael Syskind Pedersen, Smørum (DK); Jesper Jensen, Smørum (DK)

(73) Assignee: OTICON A/S, Smorum (DK)

( * ) Notice: Subject to any disclaimer, the term of this patent is extended or adjusted under 35 U.S.C. 154(b) by 0 days. days.

(21) Appl. No.: 15/669,020

(22) Filed: Aug. 4, 2017

(65) Prior Publication Data

US 2018/0041849 A1 Feb. 8, 2018

(30) Foreign Application Priority Data

Aug. 5, 2016 (EP) ..... 16182987

(51) Int. Cl.
*H04R 5/00* (2006.01)
*H04R 25/00* (2006.01)

(52) U.S. Cl.
CPC ..... *H04R 25/552* (2013.01); *H04R 25/405* (2013.01); *H04R 25/407* (2013.01); *H04R 25/505* (2013.01); *H04R 25/554* (2013.01)

(58) Field of Classification Search
CPC .. H04R 25/552; H04R 25/405; H04R 25/407; H04R 25/505
See application file for complete search history.

(56) References Cited

U.S. PATENT DOCUMENTS

2016/0112811 A1* 4/2016 Jensen ..... H04R 5/033 381/17

OTHER PUBLICATIONS

Braun et al., "Narrowband direction-of-arrival estimation for binaural hearing aids using relative transfer functions", 2015 IEEE Workshop on Applications of Signal Processing to Audio and Acoustics (WAS PAA), IEEE, Oct. 18, 2015, XP032817925, DOI: 10.1109/WASPAA.2015.7336917, (retrieved on Nov. 24, 2015); 6 pages.

(Continued)

*Primary Examiner* — Simon King
(74) *Attorney, Agent, or Firm* — Birch, Stewart, Kolasch & Birch, LLP

(57) ABSTRACT

A hearing aid system comprising a pair of hearing devices, e.g. hearing aids, worn at the ears of a user receives a target signal generated by a target signal source and transmitted through an acoustic channel to microphones of the hearing aid system. Due to (potential) additive environmental noise, a noisy acoustic signal is received at the microphones of the hearing system. An essentially noise-free version of the target signal is simultaneously transmitted to the hearing devices of the hearing system via a wireless connection. Based on a sound propagation model of the acoustic propagation channel from the target sound source to the microphones of the hearing aid system, and on relative transfer functions representing direction-dependent filtering effects of the head and torso of the user in the form of direction-dependent acoustic transfer functions from a microphone on one side of the head, to a microphone on the other side of the head, a direction-of-arrival (DoA) of the target sound signal relative to the user is determined using a maximum likelihood approach.

20 Claims, 9 Drawing Sheets

(56) References Cited

OTHER PUBLICATIONS

Farmani et al., "Informed TDoA-based direction of arrival estimation for hearing aid applications", 2015 IEEE Global Conference on Signal and Information Processing (GLOBALSIP), IEEE, Dec. 14, 2015, XP032371790, DOI: 10.1109/GLOBALSIP.2015.7418338, (retrieved on Feb. 23, 2015); pp. 953-957.

Farmani et al., "Maximum likelihood approach to "informed" sound source localization for hearing aid applications", 2015 IEEE International Conference on Acoustics, Speech and Signal Processing (ICASSP). Apr. 1, 2015, XP055249035, DOI: 10.1109/ICASSP.2015.7177923, pp. 16-20.

Farmani et al., Informed Direction of Arrival Estimation using a Spherical-head Model for Hearing Aid Applications, 2016 IEEE International. Conference on Acoustics, Speech and Signal Processing (ICASSP), IEEE, Mar. 20, 2016 , XP032900623, DOI: 10,1109/ICASSP.2016.7471697 (retrieved May 18, 2016), pp. 360-364.

Li et al.. "Binaural Sound Source Localization based on Direct-Path Relative Transfer Function", Sep. 1, 2015, XP055340773, https://pdfs.sernanticscholar.org/c689/5637f089c9c7cfae77fc8aa3db4349f37c6a.pdf (retrieved on Jan. 31, 2017), 12 pages.

* cited by examiner

BINAURAL HEARING SYSTEM CONFIGURED TO LOCALIZE A SOUND SOURCE

SUMMARY

The present disclosure deals with the problem of estimating the direction to one or more sound sources of interest—relative to the hearing aids (or the nose) of the hearing aid user. It is assumed that the target sound source(s) are in the frontal half-plane with respect to the hearing aid user. We assume that the target sound sources are equipped with wireless transmission capabilities and that the target sound is transmitted via this wireless link to the hearing aid(s) of a hearing aid user. Hence, the hearing aid system receives the target sound(s) acoustically via its microphones, and wirelessly, e.g., via an electro-magnetic transmission channel (or other wireless transmission options). We also assume that the user wears two hearing aids, and that the hearing aids are able to exchange (e.g. wirelessly) information, e.g., microphone signals.

Given i) the received acoustical signal which consists of the target sound and potential background noise, and ii) the wireless target sound signal, which is (essentially) noise-free because the wireless microphone is close to the target sound source, the goal of the present disclosure is to estimate the direction-of-arrival (DOA) of the target sound source, relative to the hearing aid system. The term 'noise free' is in the present context (the wirelessly propagated target signal) taken to mean 'essentially noise-free' or 'comprising less noise than the acoustically propagated target sound'.

The target sound source may e.g. comprise a voice of a person, either directly from the persons' mouth or presented via a loudspeaker. Pickup of a target sound source and wireless transmission to the hearing aids may e.g. be implemented as a wireless microphone attached to or located near the target sound source (see e.g. FIG. 4), e.g. located on a conversation partner in a noisy environment (e.g. a cocktail party, in a car cabin, plane cabin, etc.), or located on a lecturer in a "lecture-hall situation", etc. The target sound source may also comprise music or other sound played live or presented via one or more loudspeakers. The target sound source may also be a communication device with wireless transmission capability, e.g. a radio/TV comprising a transmitter, which transmits the sound signal wirelessly to the hearing aids.

It is advantageous to estimate the direction to (and/or location) of the target sound sources for several purposes: 1) the target sound source may be "binauralized" i.e., processed and presented binaurally to the hearing aid user with correct spatial—in this way, the wireless signal will sound as if originating from the correct spatial position, 2) noise reduction algorithms in the hearing aid system may be adapted to the presence of this known target sound source at this known position, 3) visual (or by other means) feedback—e.g., via a portable computer—to the hearing aid user about the location of the wireless microphone(s), either as simple information or as part of a user interface, where the hearing aid user can control the appearance (volume, etc.) of the various wireless sound sources.

Our co-pending European patent application (no. 14189708.2, filed on 21 Oct. 2014, and having the title 'Hearing system', and published as EP3013070A2) and European patent application (no. EP15189339.3, filed on 12 Oct. 2015, and having the title 'A hearing device and a hearing system configured to localize a sound source') also deal with the topic of sound source localization in a hearing aid.

However, compared to these disclosures, the present disclosure differs in that it performs better for a large range of different acoustic situations (background noise types, levels, reverberation, etc.), and at a hearing aid friendly memory and computational complexity.

An object of the present disclosure to estimate the direction to and/or location of a target sound source relative to a user wearing a hearing aid system comprising input transducers (e.g. microphones) located at left and right ears of a user.

To estimate the location of and/or direction to the target sound source, assumptions are made about the signals reaching the input transducers (e.g. microphones) of the hearing aid system and about their propagation from the emitting target source to the input transducers (microphones). In the following, these assumptions are briefly outlined.

Signal Model:

A signal model of the form:

$$r_m(n)=s(n)*h_m(n,\theta)+v_m(n),\ (m=\{\text{left,right}\}\text{ or }\{1,2\})$$

is assumed. We operate in the short-time Fourier transform domain, which allows all involved quantities to be written as functions of a frequency index k, a time (frame) index l, and the direction-of-arrival (angle) θ (see Eq. (1)-(3) below)

Maximum Likelihood Framework:

The general goal is to estimate the direction-of-arrival θ using a maximum likelihood framework. To this end, we assume that the (complex-valued) noise DET coefficients follow a Gaussian distribution (see Eq. (4) below).

Assuming that noisy DFT coefficients are statistically independent across frequency k allows the likelihood function L for a given frame (with index l) to be as expressed (see Eq. (5) below).

Discarding terms in the expression for L that do not depend on θ, and operating on the log of the likelihood value, rather than the likelihood value itself, a simplified expression for the maximum likelihood function L can be expressed (see Eq. (6) below).

A maximum likelihood framework may e.g. comprise the definition or estimation of one or more (such as all) of the following items:

A. A signal model (cf. e.g. eq. (1) below).

B. An acoustic propagation channel, including a head model.

C. A likelihood function dependent on the signal model and the acoustic propagation channel (cf. e.g. eq. (5) or (6) below).

D. Finding a solution that maximizes the likelihood function (cf. e.g. eq. (38) below).

Relative Transfer Functions:

The proposed method uses at least two input transducers (e.g. hearing aid microphones, as exemplified in the following), one located on/at each ear of the hearing aid user (it assumes that hearing aids can exchange information, e.g. wirelessly). It is well-known that the presence of the head influences the sound before it reaches the microphones, depending on the direction of the sound. The proposed method is e.g. different from existing methods in the way it takes the head presence into account. In the proposed method, the direction-dependent filtering effects of the head is represented by relative transfer functions (RTFs), i.e., the (direction-dependent) acoustic transfer function from the microphone on one side of the head, to the microphone on the other side of the head. For a particular frequency and direction-of-arrival, the relative transfer function is a complex-valued quantity, denoted as $\Psi_{ms}(k, \theta)$ (see Eq. (13) below). The magnitude of this complex number (expressed in [dB]) is referred to as the inter-aural level difference, while the argument is referred to as the inter-aural phase difference.

Proposed DoA Estimator:

We assume that RTFs are measured for relevant frequencies k and directions theta in an offline measurement procedure, e.g. in a sound studio using hearing aids mounted on a head-and-torso-simulator (FIATS). The measured RTFs $\Psi_{ms}(k, \theta)$ are e.g. stored in the hearing aid (or otherwise available to the hearing aid).

The basic idea of the proposed estimator is to evaluate all possible RTF values $\Psi_{ms}(k, \theta)$ in the expression for the likelihood function (see Eq. (6) below) for a given noisy signal observation. The particular RTF that leads to the maximum value is then the maximum likelihood estimate, and the direction associated with this DoA is the quantity of interest.

To evaluate efficiently all possible RTF values in the likelihood function, we divide the stored RTF values $\Psi_{ms}(k, \theta)$ in two sets. One set for θ in the range [−90°-0°] (i.e., RTFs representing target sound source directions in the front-left half plane, and the other set [0°-90°] representing sound sources in the front-right half-plane.

We may thus describe the procedure in evaluating the RTF values in the first set, i.e. θ in the range [−90°-0°]. For a particular θ in the front-left half plane, we approximate the acoustic transfer function from the target position to the microphone in the left-ear hearing aid as an attenuation and a delay (i.e., it is assumed to be frequency-independent). Using this assumption, the likelihood function can be written as Eq. (34) below (which uses Eqs. (32) and (33) below). It is important to note that the numerator in Eq. (34) below, for the θ under evaluation, has the form of an inverse discrete Fourier transform (IDFT) in terms of $D_{left}$. Hence, computing an IDFT, Eq. (34) below may be evaluated efficiently for many different possibilities of $D_{left}$, and the maximum value of $D_{left}$ (still for a particular θ) is identified and stored. This procedure is repeated for each and every θ in the front-left range [−90°-0°].

A similar approach can be followed for θs in the front-right half plane, i.e., the θ range [0°-90°]. For these θ values, Eq. (35) below is evaluated efficiently using IDFTs. Finally, the θ value which leads to the maximum L (across expressions (34) and (35), i.e., Eq. (38) below) is chosen as the DoA estimate for this particular time frame.

A Hearing Aid System:

In an aspect, a hearing aid system adapted to be worn at or on the head of a user is provided. The left hearing device comprises at least one left input transducer ($M_{left}$) for converting received sound signal to an electric input signal ($r_{left}$), the input sound comprising a mixture of a target sound signal from a target sound source and a possible additive noise sound signal at the location of the at least one left input transducer. The right hearing device comprises at least one right input transducer ($M_{right}$) for converting received sound signal to an electric input signal ($r_{right}$), the input sound comprising a mixture of a target sound signal from a target sound source and a possible additive noise sound signal at the location of the at least one right input transducer. The hearing aid system further comprises a first transceiver unit configured to receive a wirelessly transmitted version of the target signal and providing an essentially noise-free target signal; and a signal processing unit connected to said at least one left input transducer, to said at least one right input transducer, and to said wireless transceiver unit, the signal processing unit being configured to be used for estimating a direction-of-arrival of the target sound signal relative to the user based on a signal model for a received sound signal $r_m$ at microphone $M_m$ (m=left, right) through an acoustic propagation channel from the target sound source to the microphone m when worn by the user;

a maximum likelihood framework;

relative transfer functions representing direction-dependent filtering effects of the head and torso of the user in the form of direction-dependent acoustic transfer functions from a microphone on one side of the head, to a microphone on the other side of the head.

The additive noise may come from the environment and/or from the hearing aid system itself (e.g. microphone noise).

The symbols RTF and $\Psi_{ms}$ are used interchangeably for the relative transfer functions defining the direction-dependent relative acoustic transfer functions from a microphone on one side of the head to a microphone on the other side of the head. The relative transfer function $RTF(M_{left} \rightarrow M_{right})$ from microphone $M_{left}$ to microphone $M_{right}$ (located at left and right ears, respectively) can be approximated by the inverse of the relative transfer function $RTF(M_{right} \rightarrow M_{left})$ from microphone $M_{right}$ to microphone $M_{left}$. This has the advantage that a database of relative transfer functions requires less storage capacity than a corresponding database of head related transfer functions HRTF (which are (generally) different for the left and right hearing devices (ears, microphones)). Furthermore, for a given frequency and angle, the head related transfer functions ($HRTF_L$, $HRTF_R$) can be represented by two complex numbers, whereas the relative function RTF can be represented by one complex number. Hence the use of RTFs is advantageous to use in a miniature (e.g. portable) electronic device with a relatively small power capacity, e.g. a hearing aid or hearing aid system.

In an embodiment, the head related transfer functions (HRTF) are (generally assumed to be) frequency independent. In an embodiment, the relative transfer functions (RTF) are (generally assumed to be) frequency dependent.

In an embodiment, the hearing aid system is configured to provide that the signal processing unit has access to a database of relative transfer functions $\Psi_{ms}$ for different directions (θ) relative to the user. In an embodiment, the database of relative transfer functions $\Psi_{ms}$ for different directions (θ) relative to the user are frequency dependent (so that the database contains values of the relative transfer function $\Psi_{ms}(\theta, f)$ for a given location (direction θ) at different frequencies f, e.g. the frequencies distributed over the frequency range of operation of the hearing aid system.

In an embodiment, the database of relative transfer functions $\Psi_{ms}$ is stored in a memory of the hearing aid system. In an embodiment, the database of relative transfer functions $\Psi_{ms}$ is obtained from corresponding head related transfer functions (HRTF), e.g. for the specific user. In an embodiment, the database of relative transfer functions $\Psi_{ms}$ are based on measured data, e.g. on a model of the human head and torso (e.g. on the Head and Torso Simulator (HATS) Type 4128C from Brüel and Kjaer Sound & Vibration Measurement A/S or the KEMAR model from G.R.A.S. Sound & Vibration), or on the specific user. In an embodiment, the database of relative transfer functions $\Psi_{ms}$ is generated during use of the hearing aid system (as e.g. proposed in EP2869599A).

In an embodiment, the signal model is given by the following expression $$r_m(n)=s(n)*h_m(n,\theta)+v_m(n),\ (m=\{\text{left,right}\}\text{ or }\{1,2\}),$$

where s is the essentially noise-free target signal emitted by the target sound source, $h_m$ is the acoustic channel impulse response between the target sound source and microphone m, and $v_m$ is an additive noise component, θ is an angle of a direction-of-arrival of the target sound source relative to a reference direction defined by the user and/or by the location of the first and second hearing devices at the ears of the user, n is a discrete time index, and * is the convolution operator.

In an embodiment, the hearing aid system is configured to provide that said left and right hearing devices, and said signal processing unit are located in or constituted by three physically separate devices. The term 'physically separate device' is in the present content taken to mean that each device has its own separate housing and that the devices are operationally connected via wired or wireless communication links.

In an embodiment, the hearing aid system is configured to provide that each of said left and right hearing devices comprise a signal processing unit, and to provide that information signals, e.g. audio signals, or parts thereof, can be exchanged between the left and right hearing devices.

In an embodiment, the hearing aid system comprises a time to time-frequency conversion unit for converting an electric input signal in the time domain into a representation of the electric input signal in the time-frequency domain, providing the electric input signal at each time instance 1 in a number for frequency bins k, k=1, 2, . . . , N.

In an embodiment, the signal processing unit is configured to provide a maximum-likelihood estimate of the direction of arrival θ of the target sound signal.

In an embodiment, the sound propagation model of an acoustic propagation channel from the target sound source to the hearing device when worn by the user comprises a signal model defined by $$R_m(l,k)=S(l,k)H_m(k,\theta)+V_m(l,k)$$

where $R_m(l, k)$ is a time-frequency representation of the noisy target signal, S(l, k) is a time-frequency representation of the noise-free target signal, $H_m(k, \theta)$ is a frequency transfer function of the acoustic propagation channel from the target sound source to the respective input transducers of the hearing devices, and $V_m(l, k)$ is a time-frequency representation of the additive noise.

In an embodiment, the estimate of the direction-of-arrival of the target sound signal relative to the user is based on the assumptions that the additive noise follows a circularly symmetric complex Gaussian distribution. In particular that the complex-valued noise Fourier transformation coefficients (e.g. e.g. DFT coefficients) follow a Gaussian distribution (cf. e.g. Eq. (4) below). In an embodiment, it is further assumed that noisy Fourier transformation coefficients (e.g. DFT coefficients) are statistically independent across frequency index k.

In an embodiment, the acoustic channel parameters from a sound source to an ear of the user are assumed to be frequency independent (free-field assumption) on the part of the channel from sound source to the head of the user, whereas the acoustic channel parameters of the part that propagate through the head are assumed to be frequency dependent. In an embodiment, the latter (frequency dependent parameters) are represented by the relative transfer functions (RTF). In the examples of FIGS. 2A and 2B, this is illustrated in that the head related transfer functions HRTF from the sound source S to the ear in the same (front) quarter plane as the sound source S (left ear in FIG. 2A, right ear in FIG. 2B) are indicated to be functions of direction (θ) (but not frequency). The head related transfer function (HRTF) is typically understood to represent a transfer function from a sound source (at a given location) to an ear drum of a given ear. The relative transfer functions (RTF) are in the present context taken to represent transfer functions from a sound source (at a given location) to each input unit (e.g. microphone) relative to a reference input unit (e.g. microphone).

In an embodiment, the signal processing unit is configured to provide a maximum-likelihood estimate of the direction of arrival θ of the target sound signal by finding the value of θ, for which the log likelihood function is maximum, and wherein the expression for the log likelihood function is adapted to allow a calculation of individual values of the log likelihood function for different values of the direction-of-arrival (θ) using the inverse Fourier transform, e.g. IDFT, such as IFFT.

In an embodiment, the at least one input transducer of the left hearing devices is equal to one, e.g. a left microphone, and wherein the at least one input transducer of the right hearing devices is equal to one, e.g. a right microphone. In an embodiment, the at least one input transducer of the left or right hearing devices is larger than or equal to two.

In an embodiment, the hearing aid system is configured to approximate the acoustic transfer function from a target sound source in the front-left quarter plane (−90°-0°) to the at least one left input transducer and the acoustic transfer function from a target sound source in the front-right quarter plane (0°-+90°) to the at least one right input transducer as frequency-independent acoustic channel parameters (attenuation and delay).

In an embodiment, the hearing aid system is configured to evaluate the log likelihood function L for relative transfer functions $\Psi_m$ corresponding to the directions on the left side of the head (θ ϵ [−90°; 0°]), where the acoustic channel parameters of a left input transducer, e.g. a left microphone, are assumed to be frequency independent. In an embodiment, the hearing aid system is configured to evaluate the log likelihood function L for relative transfer functions $\Psi_{ms}$ corresponding to the directions on the right side of the head (θ ϵ [0°; +90°]), where the acoustic channel parameters of a right input transducer, e.g. a right microphone, are assumed to be frequency independent. In an embodiment, the acoustic channel parameters of the left microphone include frequency independent parameters $\alpha_{left}(\theta)$ and $D_{left}(\theta)$. In an embodiment, the acoustic channel parameters are represented the by left and right head related transfer functions (HRTF).

In an embodiment, at least one of the left and right hearing devices comprises a hearing aid, a headset, an earphone, an ear protection device or a combination thereof.

In an embodiment, the sound propagation model is frequency independent. In other words, it is assumed that all frequencies is attenuated and delayed in the same way (full band model). This has the advantage of allowing computationally simple solutions (suitable for portable devices with limited processing and/or power capacity). In an embodiment, the sound propagation model is frequency independent in a frequency range (e.g. below a threshold frequency, e.g. 4 kHz), which form part of the frequency range of a frequency range of operation of the hearing device (e.g. between a minimum frequency ($F_{min}$, e.g. 20 Hz or 50 Hz or 250 Hz) and a maximum frequency ($f_{max}$, e.g. 8 kHz or 10 kHz). In an embodiment, the frequency range of operation of the hearing device is divided into a number (e.g. two or more) of sub-frequency ranges, wherein frequencies are attenuated and delayed in the same way within a given sub-frequency range (but differently from sub-frequency range to sub-frequency range).

In an embodiment, the reference direction is defined by the user (and/or by the location of first and second (left and right) hearing devices on the body (e.g. the head, e.g. at the ears) of the user), e.g. defined relative to a line perpendicular to a line through the first and second input transducers (e.g. microphones) of the first and second (left and right) hearing devices, respectively. In an embodiment, the first and second input transducers of the first and second hearing devices, respectively, are assumed to be located on opposite sides of the head of the user (e.g. at or on or in respective left and right ears of the user).

In an embodiment, the relative level difference (ILD) between the signals received at the left and right hearing devices is determined in dB. In an embodiment, the time difference (ITD) between the signals received at the left and right hearing devices is determined in s (seconds) or a number of time samples (each time sample being defined by a sampling rate).

In an embodiment, the hearing device comprises a time to time-frequency conversion unit for converting an electric input signal in the time domain into a representation of the electric input signal in the time-frequency domain, providing the electric input signal at each time instance 1 in a number for frequency bins k, k=1, 2, . . . , N. In an embodiment, the time to time-frequency conversion unit comprises a filter bank. In an embodiment, the time to time-frequency conversion unit comprises a Fourier transformation unit, e.g. comprising a Fast Fourier transformation (FFT) algorithm, or a Discrete Fourier Transformation (DFT) algorithm, or a short time Fourier Transformation (STFT) algorithm.

In an embodiment, the signal processing unit is configured to provide a maximum-likelihood estimate of the direction of arrival θ of the target sound signal.

In an embodiment, the hearing system is configured to calculate the direction-of-arrival (only) in case the likelihood function is larger than a threshold value. Thereby, power can be saved in cases where the conditions for determining a reliable direction-of-arrival of a target sound are poor. In an embodiment, the wirelessly received sound signal is not presented to the user when no direction-of-arrival has been determined. In an embodiment, a mixture of the wirelessly received sound signal and the acoustically received signal is presented to the user.

In an embodiment, the hearing device comprises a beamformer unit and the signal processing unit is configured to use the estimate of the direction of arrival of the target sound signal relative to the user in the beamformer unit to provide a beamformed signal comprising the target signal. In an embodiment, the signal processing unit is configured to apply a level and frequency dependent gain to an input signal comprising the target signal and to provide an enhanced output signal comprising the target signal. In an embodiment, the hearing device comprises an output unit adapted for providing stimuli perceivable as sound to the user based on a signal comprising the target signal. In an embodiment, the hearing device is configured to estimate head related transfer functions based on the estimated inter-aural time differences and inter aural level differences.

In an embodiment, the hearing device (or system) is configured to switch between different sound propagation models depending on a current acoustic environment and/or on a battery status indication. In an embodiment, the hearing device (or system) is configured to switch to a (computationally) lower sound propagation model based on an indication from a battery status detector that the battery status is relatively low.

In an embodiment, the first and second hearing devices each comprises antenna and transceiver circuitry configured to allow an exchange of information between them, e.g. status, control and/or audio data. In an embodiment, the first and second hearing devices are configured to allow an exchange of data regarding the direction-of-arrival as estimated in a respective one of the first and second hearing devices to the other one and/or audio signals picked up by input transducers (e.g. microphones) in the respective hearing devices.

In an embodiment, the hearing device comprises one or more detectors for monitoring a current input signal of the hearing device and/or on the current acoustic environment (e.g. including one or more of a correlation detector, a level detector, a speech detector).

In an embodiment, the hearing device comprises a level detector (LD) for determining the level of an input signal (e.g. on a band level and/or of the full (wide band) signal).

In an embodiment, the hearing device comprises a voice activity detector (VAD) configured to provide control signal comprising an indication (e.g. binary, or probability based) whether an input signal (acoustically or wirelessly propagated) comprises a voice at a given point in time (or in a given time segment).

In an embodiment, the hearing device (or system) is configured to switch between local and informed estimation direction-of-arrival depending of a control signal, e.g. a control signal from a voice activity detector. In an embodiment, the hearing device (or system) is configured to only determine a direction-of-arrival as described in the present disclosure, when a voice is detected in an input signal, e.g. when a voice is detected in the wirelessly received (essentially) noise-free signal. Thereby power can be saved in the hearing device/system.

In an embodiment, the hearing device comprises a battery status detector providing a control signal indication a current status of the battery (e.g. a voltage, a rest capacity or an estimated operation time).

In an embodiment, the hearing aid system comprises an auxiliary device. In an embodiment, the hearing aid system is adapted to establish a communication link between the hearing device(s) and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme). In an embodiment, the auxiliary device is or comprises a smartphone.

A Method:

In an aspect, a method of operating a hearing aid system comprising left and right hearing devices adapted to be worn at left and right ears of a user is provided. The method comprises converting a received sound signal to an electric input signal ($r_{left}$) at a left ear of the user, the input sound comprising a mixture of a target sound signal from a target sound source and a possible additive noise sound signal at the left ear;

converting a received sound signal to an electric input signal ($r_{right}$) at a right ear of the user, the input sound comprising a mixture of a target sound signal from a target sound source and a possible additive noise sound signal at the right ear;

receiving a wirelessly transmitted version (s) of the target signal and providing an essentially noise-free target signal;

processing said electric input signal ($r_{left}$), said electric input signal ($r_{right}$), and said wirelessly transmitted version (s) of the target signal, and based thereon estimating a direction-of-arrival of the target sound signal relative to the user based on a signal model for a received sound signal $r_m$ at microphone $M_m$ (m=left, right) through an acoustic propagation channel from the target sound source to the microphone m when worn by the user;

a maximum likelihood framework;

relative transfer functions representing direction-dependent filtering effects of the head and torso of the user in the form of direction-dependent acoustic transfer functions from a microphone on one side of the head, to a microphone on the other side of the head.

It is intended that some or all of the structural features of the system described above, in the 'detailed description of embodiments' or in the claims can be combined with embodiments of the method, when appropriately substituted by a corresponding process and vice versa. Embodiments of the method have the same advantages as the corresponding system.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

An APP:

In a further aspect, a non-transitory application, termed an APP, is furthermore provided by the present disclosure. The APP comprises executable instructions configured to be executed on an auxiliary device to implement a user interface for a hearing device or a hearing aid system as described above in the 'detailed description of embodiments', and in the claims. In an embodiment, the APP is configured to run on cellular phone, e.g. a smartphone, or on another portable device allowing communication with said hearing device or said hearing system.

DEFINITIONS

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing devices, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

DETAILED DESCRIPTION OF EMBODIMENTS

The problem addressed by the present disclosure is to estimate the location of a target sound source relative to a user wearing a hearing aid system comprising first and second hearing devices, at least comprising an input transducer located at each of the user's left and right ears.

A number of assumptions are made a) about the signals reaching the input transducers (e.g. microphones) of the hearing aid system and b) about their propagation from the emitting target source to the input transducers (e.g. microphones). These assumptions are outlined in the following.

Reference regarding the further details of the present disclosure in general is made to [3], in particular to the following sections thereof:

Sec. II: Signal Model.

Sec. III: Maximum Likelihood Framework.

Sec. IV before IV-A: Relative Transfer Function (RTF) Models.

Sec. IV-C: The Measured RTF-Model.

Sec. V before V-A: Proposed DoA Estimators.

Sec. V-C: The Measured RTF-Model DoA Estimator.

Figure 1A:
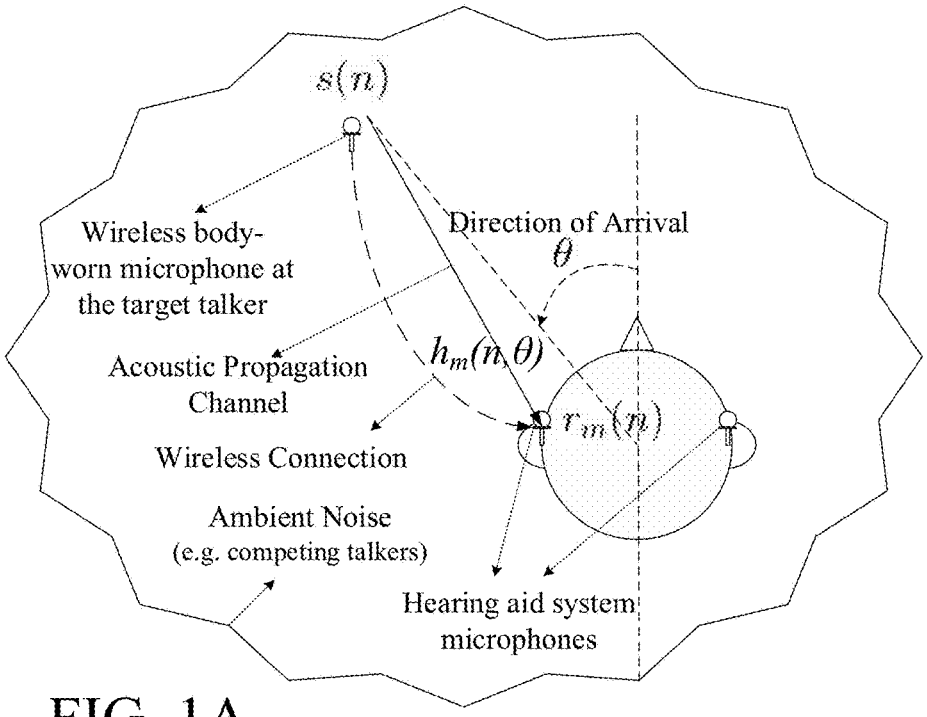
FIG. 1A shows an "informed" binaural direction of arrival (DoA) estimation scenario for a hearing aid system using a wireless microphone, wherein $r_m(n)$, $s(n)$ and $h_m(n, \theta)$ are the noisy received sound at microphone m, the (essentially) noise-free target sound, and the acoustic channel impulse response between a target talker and microphone m, respectively.

FIG. 1A illustrates a relevant scenario. A speech signal $s(n)$ (a target signal, n being a time index) generated by a target talker (signal source) and picked up by a microphone at the talker (cf. Wireless body-worn microphone at the target talker) is transmitted through an acoustic channel $h_m(n, \theta)$ (transfer function of the Acoustic Propagation Channel) and reaches microphone in (m=1, 2 or left, right) of a hearing system, e.g. comprising first and second a hearing aids (cf. Hearing aid system microphones) located at left and right ears of a user (indicated by symbolic top view of a head with ears and nose). Due to (potential) additive environmental noise (cf. Ambient Noise (e.g. competing talkers)), a noisy signal $r_m(n)$ (comprising the target signal and environmental noise) is received at microphone m (here a microphone of a hearing device located at the left ear of the user). The essentially noise-free target signal $s(n)$ is transmitted to the hearing device via a wireless connection (cf. Wireless Connection) (the term 'essentially noise-free target signal $s(n)$' indicates the assumption that $s(n)$—at least typically—comprises less noise than the signal $r_m(n)$ received by the microphones at the user). An aim of the present disclosure is to estimate the direction of arrival (DoA) (cf. Direction of Arrival) of the target signal relative to the user using these signals (cf. angle θ relative to a direction defined by dashed line through the tip of the user's nose).

Figure 1B:
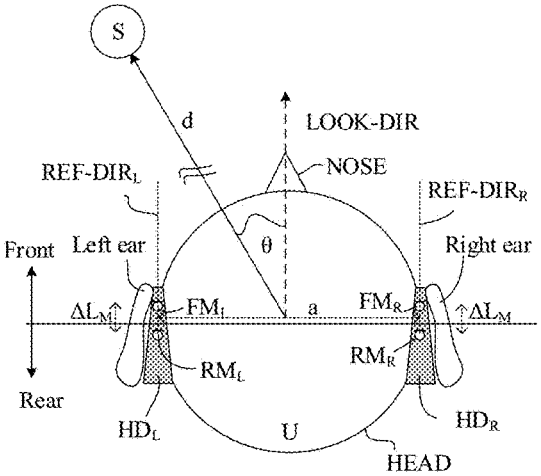
FIG. 1B schematically illustrates a geometrical arrangement of sound source relative to a hearing aid system comprising first and second hearing devices when located at or in first (left) and second (right) ears, respectively, of the user.

FIG. 1B schematically illustrates a geometrical arrangement of sound source relative to a hearing aid system comprising left and right hearing devices ($HD_L$, $HD_R$) when located on the head (HEAD) at or in left (Left ear) and right (Right ear) ears, respectively, of a user (U). The setup is similar to the one described above in connection with FIG. 1A. Front and rear directions and front and rear half planes of space (cf. arrows Front and Rear) are defined relative to the user (U) and determined by the look direction (LOOK-DIR, dashed arrow) of the user (defined by the user's nose (NOSE)) and a (vertical) reference plane through the user's ears (solid line perpendicular to the look direction (LOOK-DIR)). The left and right hearing devices ($HD_L$, $HD_R$) each comprise a BTE-part located at or behind-the-ear (BTE) of the user. In the example of FIG. 1B, each BTE-part comprises two microphones, a front located microphone ($FM_L$, $FM_R$) and a rear located microphone ($RM_L$, $RM_R$) of the left and right hearing devices, respectively. The front and rear microphones on each BTE-part are spaced a distance $\Delta L_M$ apart along a line (substantially) parallel to the look direction (LOOK-DIR), see dotted lines $REF\text{-}DIR_L$ and $REF\text{-}DIR_R$, respectively. As in FIG. 1A, a target sound source S is located at a distance d from the user and having a direction-of-arrival defined (in a horizontal plane) by angle θ relative to a reference direction, here a look direction (LOOK-DIR) of the user. In an embodiment, the user U is located in the far field of the sound source S (as indicated by broken solid line d). The two sets of microphones ($FM_L$, $RM_L$), ($FM_R$, $RM_R$) are spaced a distance a apart.

In the following, equation numbers '(p)' correspond to the outline in [3].

Signal Model:

Generally, we assume a signal model of the form describing the noisy signal $r_m$ received by the $m^{th}$ input transducer (e.g. microphone m):

$$r_m(n)=s(n)*h_m(n,\theta)+v_m(n),\ (m=\{\text{left,right}\}\text{ or }\{1,2\}). \tag{1}$$

where s, $h_m$ and $v_m$ are the (essentially) noise-free target signal emitted at the target talker's position, the acoustic channel impulse response between the target talker and microphone m, and an additive noise component, respectively. θ is the angle of the direction-of-arrival of the target sound source relative to a reference direction defined by the user (and/or by the location of the left and right hearing devices on the body (e.g. the head, e.g. at the ears) of the user), n is a discrete time index, and * is the convolution operator. In an embodiment, a reference direction is defined by a look direction of the user (e.g. defined by the direction that the user's nose point in (when seen as an arrow tip), cf. e.g. FIG. 1A, 1B). In an embodiment, the short-time Fourier transform domain (STFT) is used, which allows all involved quantities to be expressed as functions of a frequency index k, a time (frame) index l, and the direction-of-arrival (angle) θ.

The use of the STFT domain allows frequency dependent processing, computational efficiency and the ability to adapt to the changing conditions, including low latency algorithm implementations. Therefore, let $R_m(l, k)$, $S(l, k)$ and $V_m(l, k)$ denote the STFT of $r_m$, s and $v_m$, respectively. In an embodiment, it is assumed that S also includes source (e.g. mouth) to microphone transfer function and microphone response. Specifically, $$R_m(l, k) = \sum_n r_m(n)w(n - lA)e^{-\frac{j2\pi k}{N}(n-lA)}$$

where m={left, right}, l and k are frame and frequency bin indexes, respectively, N is the discrete Fourier transform (DFT) order, A is a decimation factor, w(n) is the windowing function, and $j=\sqrt{(-1)}$ is the imaginary unit. $S(l, k)$ and $V_m(l, k)$ are defined similarly. Moreover, let $H_m(k, \theta)$ denote the Discrete Fourier Transform (DFT) of the acoustic channel impulse response $h_m$:

$$\begin{aligned} H_m(k, \theta) &= \Sigma_n h_m(n, \theta)e^{-\frac{j2\pi kn}{N}}, \\ &= \propto_m (k, \theta)e^{-\frac{j2\pi k}{N}D_m(k,\theta)}, \end{aligned} \tag{2}$$

where m={left, right}, N is the DFT order, $\alpha_m(k, \theta)$ is a real number and denotes the frequency-dependent attenuation factor due to propagation effects, and $D_m(k, \theta)$ is the frequency-dependent propagation time from the target sound source to microphone m.

Eq. (1) can be approximated in the STFT domain as:

$$R_m(l,k)=S(l,k)H_m(k,\theta)+V_m(l,k). \tag{3}$$

This approximation is known as the multiplicative transfer function (MTF) approximation, and its accuracy depends on the length and smoothness of the windowing function w(n): the longer and the smoother the support of w(n), the more accurate the approximation.

Maximum Likelihood Framework:

The general goal is to estimate the direction-of-arrival θ using a maximum likelihood framework. To this end, we assume that the (complex-valued) noise DFT coefficients follow a Gaussian distribution.

To define the likelihood function, we assume the additive noise V(l, k) is distributed according to a zero-mean circularly-symmetric complex Gaussian distribution:

$$V(l, k) = \begin{bmatrix} V_{left} \\ V_{right} \end{bmatrix} \sim \aleph(0, C_v(l.k)), \tag{4}$$

where $C_v(l, k)$ is the noise cross power spectral density (CPSD) matrix defined as $C_v(l, k)=E\{V(l, k)V^H(l, k)\}$, where E{.} and superscript $^H$ represent the expectation and Hermitian transpose operators, respectively. Further, it is assumed that the noisy observations are independent across frequencies (strictly speaking, this assumption holds when the correlation time of the signal is short compared with the frame length). Therefore, the likelihood function for frame l is defined by equation (5) below:

$$p(\underline{R}(l); \underline{H}(\theta) = \prod_{k=0}^{N-1} \frac{1}{\pi^M |C_v(l, k)|} e^{\{-(Z(l,k))^H C_v^{-1}(l,k)(Z(l,k))\}}, \tag{5}$$

where |.| denotes the matrix determinant, N is the DFT order, and $$\underline{R}(l) = [R(l, 0), R(l, 1), \ldots, R(l, N-1)],$$

$$R(l, k) = [R_{left}(l, k), R_{right}(l, k)]^T,$$

$$\underline{H}(\theta) = [H(0, \theta), H(1, \theta), \ldots, H(N-1, \theta)]$$

$$H(k, \theta) = [H_{left}(k, \theta), H_{right}(k, \theta)]^T = \begin{bmatrix} \propto_{left}(k, \theta)e^{-\frac{j2\pi k}{N}D_{left}(k,\theta)} \\ \propto_{right}(k, \theta)e^{-\frac{j2\pi k}{N}D_{right}(k,\theta)} \end{bmatrix},$$

$$Z(l, k) = R(l, k) - S(l, k)H(k).$$

To reduce the computational overhead, we consider the log-likelihood function and omit the terms independent of θ. The corresponding log-likelihood function L is given by:

$$\mathcal{L}(\underline{R}(l); \underline{H}(\theta)) = \sum_{k=0}^{N-1} \{-(Z(l, k))^H C_v^{-1}(l, k)(Z(l, k))\}, \tag{6}$$

The ML estimate of θ is found by maximizing log-likelihood function L. However, to find the ML estimate of θ, we need to model and find the ML estimate of the acoustic channels' parameters (the attenuations and the delays) in $\underline{H}(\theta)$.

Relative Transfer Function Model:

In the present disclosure, we generally consider microphones, which are located on/at both ears of a hearing aid user. It is well-known that the presence of the head influences the sound before it reaches the microphones, depending on the direction of the sound.

Different ways of modelling the head's presence have been proposed. In the following, we outline a method, based on the maximum likelihood framework mentioned above and on a relative transfer function model (RTF).

The RTF between the left and the right microphones (located at left and right ears of the user, respectively) represents the filtering effect of the user's head. Moreover, this RTF defines the relation between the acoustic channels' parameters (the attenuations and the delays) corresponding to the left and the right microphone. An RTF is usually defined with respect to a reference microphone. Without loss of generality, let us consider the left microphone as the reference microphone. Therefore, considering Eq. (2), the RTF is defined by $$\Psi(k, \theta) = \frac{H_{right}(k, \theta)}{H_{left}(k, \theta)} = \Gamma(k, \theta)e^{-j2\pi\frac{k}{N}\Delta D(k,\theta)}$$

where $$\Gamma(k, \theta) = \frac{\alpha_{right}(k, \theta)}{\alpha_{left}(k, \theta)}$$

$$\Delta D(k, \theta) = D_{right}(k, \theta) - D_{left}(k, \theta)$$

We refer to Γ(k, θ) as the inter-microphone level difference (IMLD) and to ΔD(k, θ) as the inter-microphone time differences (ITD) between microphones of first and second hearing devices located on opposite sides of a user' head (e.g. at a user's ears).

Although ILD's and ITD's are conventionally defined with respect to the acoustic signals reaching the ear drums of a human, we stretch the definition to mean the level- and time-differences between microphone signals (where the microphones are typically located at/on the pinnae of the user, cf. e.g. FIG. 1A, 1B).

The Measured RTF-Model:

The measured RTF-model $\Psi_{ms}(k, \theta)$ is assumed to have access to a database of RTFs for different directions (θ), e.g. obtained from corresponding head related transfer functions (HRTF), e.g. for the specific user. The database of RTFs may e.g. be based on measured data, e.g. on a model of the human head and torso (e.g. the HATS model), or on the specific user. The database may also be generated during use of the hearing aid system (as e.g. proposed in EP2869599A).

The measured RTF model $\Psi_{ms}(k, \theta)$ is defined as $$\Psi_{ms}(k,\theta)=\Gamma_{ms}(k,\theta)e^{-j\Phi_{ms}(k,\theta)}, \tag{13}$$

where $$\Gamma_{ms}(k, \theta) = \frac{|\tilde{H}_{right}(k, \theta)|}{|\tilde{H}_{left}(k, \theta)|} \tag{14}$$

$$\Phi_{ms}(k, \theta) = \angle\frac{\tilde{H}_{right}(k, \theta)}{\tilde{H}_{left}(k, \theta)} \tag{15}$$

where $\tilde{H}_{left}(k, \theta)$ and $\tilde{H}_{right}(k, \theta)$ are the measured HRTFs for the left and right microphones, respectively, and |•| and < denote the magnitude and the phase angle of a complex number, respectively. It should be noted that formally, an HRTF is defined as "the far-field frequency response of a specific individuals' left or right ear, as measured from a specific point in the free field to a specific point in the ear canal". However, in the present disclosure this definition is relaxed definition and use the term HRTF to describe the frequency response from a target source to a microphone of the hearing aid system.

The Measured RTF Model DoA Estimator:

In the following, a DoA estimator based on the proposed RTF model using the ML framework is determined. To derive the DoA estimator, we expand the reduced log-likelihood function L in Eq. (6) and aim to make L independent of all other parameters except θ. In the derivations, we denote the inverse of the noise CPSD matrix $C_v^{-1}(l, k)$ (for the number of microphones M=2, one at each ear) as $$C_v^{-1}(l, k) = \begin{bmatrix} C_{11}(l, k) & C_{12}(l, k) \\ C_{21}(l, k) & C_{22}(l, k) \end{bmatrix}. \tag{16}$$

In the measured-RTF model, we assume that a database $\Theta_{ms}$ of measured frequency-dependent RTFs, labeled by their corresponding directions for a specific user, is available. The DoA estimator using this model is based on evaluating L for the different RTFs in $\Theta_{ms}$.

To evaluate L for each $\theta \in \Theta_{ms}$, we assume the acoustic channel parameters for the microphone, which is not in the "shadow" of the head if the sound is coming from θ direction, to be frequency independent. In other words, we assume that the acoustic transfer function from the target location to that microphone can be modeled as a frequency-independent attenuation and a frequency-independent delay. This is a reasonable assumption, because if the sound is coming from direction θ, the signal received by this microphone is almost unaltered by the head and torso of the user, i.e. this resembles a free-field situation (cf. FIG. 2A, 2B). Note that this frequency-independency assumption is only related to the acoustic channel parameters from the target to one of the microphones. The RTFs between microphones are allowed to be frequency-dependent.

To be more precise, when we evaluate L for RTFs corresponding to the directions on the left side of the head ($\theta \in [-90°; 0°]$, cf. FIG. 2A), the acoustic channel parameters of the left microphone, i.e. $\alpha_{left}(\theta)$ and $D_{left}(\theta)$, are assumed to be frequency independent. Similarly, when we evaluate L for RTFs corresponding to the directions on the right side of the head ($\theta \in [0°; +90°]$, cf. FIG. 2B), the acoustic channel parameters of the right microphone, i.e. $\alpha_{right}(\theta)$ and $D_{right}(\theta)$, are assumed to be frequency independent. As shown below, this assumption allows us to use an IDFT for evaluation of L.

To evaluate L for $\theta \in [-90°; 0°]$ (cf. FIG. 2A), let us replace $\alpha_{right}(k, \theta)$ and $D_{right}(k, \theta)$ in L with functions of $\alpha_{left}(\theta)$ and $D_{left}(\theta)$, respectively:

$$\alpha_{right}(k, \theta) = \Gamma(k, \theta)\alpha_{left}(\theta), \tag{29}$$

$$\begin{aligned} D_{right}(k, \theta &= \Delta D_{ms}(k, \theta) - D_{left}(\theta) \\ &= \frac{-N}{2\pi k}(\Phi_{ms}(k, \theta) + 2\pi\rho) + D_{left}(\theta) \end{aligned} \tag{30}$$

where $\rho$ is a phase unwrapping factor. This makes L independent of $H_{right}$ parameters. Afterwards, as before, to make L independent of $\alpha_{left}(\theta)$, we find the MLE of $\alpha_{left}(\theta)$ as functions of other parameters in L by solving $$\frac{\partial \mathcal{L}}{\partial \alpha_{left}(\theta)} = 0$$

The obtained MLE of $\alpha_{left}(\theta)$ is:

$$\hat{\alpha}_{left}(\theta) = \frac{f_{ms,left}(\theta, D_{left}(\theta))}{g_{ms,left}(\theta)} \tag{31}$$

where $$f_{ms,left}(\theta, D_{left}(\theta)) = \sum_{k=1}^{N} (C_{11}(l, k)R_{left}(l, k) + C_{12}(l, k)R_{right}(l, k) + (C_{21}(l, k)R_{left}(l, k) + C_{22}(l, k)R_{right}(l, k))\Psi^*_{ms}(k, \theta))S^*(l, k)e^{j2\pi\frac{k}{N}D_{left}(\theta)} \tag{32}$$

and $$g_{ms,left}(\theta) = \sum_{k=1}^{N} (C_{11}(l, k) + 2C_{21}(l, k)\Psi^*_{ms}(k, \theta) + \Gamma^2_{ms}(\theta)C_{22}(l, k))|S(l, k)|^2 \tag{33}$$

Substituting $\hat{\alpha}_{left}(\theta)$ in L leads to $$\mathcal{L}_{ms,left}(\underline{R}(l); \theta, D_{left}(\theta)) = \frac{f^2_{ms,left}(\theta, D_{left}(\theta))}{g_{ms,left}(\theta)} \tag{34}$$

Analogously, to evaluate L for $\theta \in [0°, +90°]$ (cf. FIG. 2B), if we replace $\alpha_{left}(k, \theta)$ and $D_{left}(k, \theta)$ in L with functions of $\alpha_{right}(\theta)$ and $D_{right}(\theta)$, respectively, and go through the similar process, we end up with $$\mathcal{L}_{ms,right}(\underline{R}(l); \theta, D_{right}(\theta)) = \frac{f^2_{ms,right}(\theta, D_{right}(\theta))}{g_{ms,right}(\theta)} \tag{35}$$

where $$f_{ms,right}(\theta, D_{right}(\theta)) = \sum_{k=1}^{N} (C_{21}(l, k)R_{left}(l, k) + C_{22}(l, k)R_{right}(l, k) + (C_{11}(l, k)R_{left}(l, k) + C_{12}(l, k)R_{right}(l, k))(\Psi^*_{ms})^{-1}(k, \theta))S^*(l, k)e^{j2\pi\frac{k}{N}D_{right}(\theta)} \tag{36}$$

and $$g_{ms,right}(\theta) = \sum_{k=1}^{N} (C_{22}(l, k) + 2C_{12}(l, k)(\Psi^*_{ms})^{-1}(k, \theta) + \Gamma^{-2}_{ms}(\theta)C_{11}(l, k))|S(l, k)|^2 \tag{37}$$

Regarding Eqs. (32) and (36), $f_{ms,left}(\theta, D_{left}(\theta))$ and $f_{ms,right}(\theta, D_{right}(\theta))$ can be seen to be IDFTs with respect to $D_{left}(\theta)$ and $D_{right}(\theta)$, respectively. Therefore, evaluating $L_{ms,left}$ and $L_{ms,right}$ results in a discrete-time sequence for a given $\theta$, and the MLE of $D_{left}(\theta)$ or $D_{right}(\theta)$ for that $\theta$ is the time index of the maximum of the sequence. Hence, the MLE of $\theta$ is then given by the global maximum:

$$\hat{\theta}_{ms} = \arg\max_{\theta \in \Theta_{ms}} \mathcal{L}_{ms}(R(l); \theta) \tag{38}$$

where $$\mathcal{L}_{ms}(\underline{R}(l); \theta) = \begin{cases} \mathcal{L}_{ms,left}(\underline{R}(l); \theta, D_{left}(\theta)), & \theta \in [-90°, 0°] \\ \mathcal{L}_{ms,right}(\underline{R}(l); \theta, D_{right}(\theta)), & \theta \in [0°, +90°] \end{cases}$$

Figure 2A:
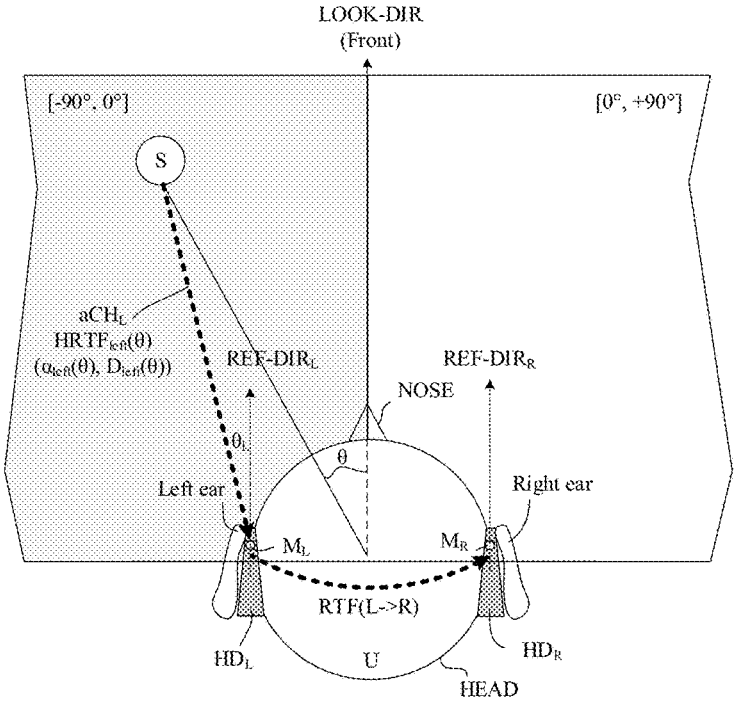
FIG. 2A schematically illustrates an example of steps in the evaluation of the maximum likelihood function L for $\theta \in [-90°; 0°]$, and FIG. 2B schematically illustrates an example of steps in the evaluation of the maximum likelihood function L for $\theta \in [0°, +90°]$.
Figure 2B:
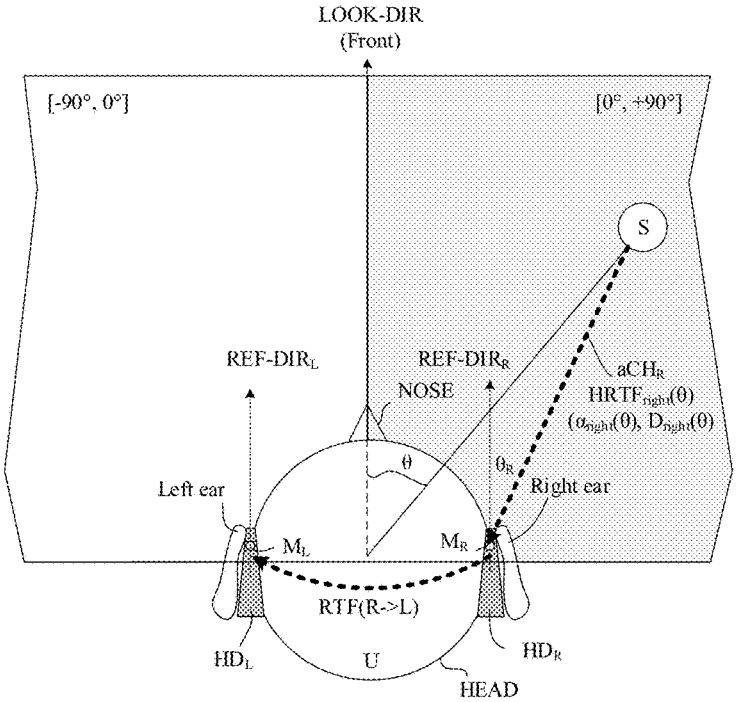

FIG. 2A schematically illustrates an example of steps in the evaluation of the maximum likelihood function L for $\theta \in [-90°; 0°]$ (left quarter plane). FIG. 2B schematically illustrates an example of steps in the evaluation of the maximum likelihood function L for $\theta \in [0°, +90°]$ (right quarter plane). FIGS. 2A and 2B uses the same terminology and illustrates the same setup as shown in FIG. 1B. The transfer function from a sound source located in a given, e.g. left, quarter plane to a microphone located in the same (e.g. left) quarter plane is modeled by a frequency independent head related transfer function $HRTF_m(\theta)$, m=left, right. The transfer function from a sound source located in a given, e.g. left, quarter plane to a microphone located in the other (e.g. right) quarter plane is modeled by a frequency independent head related transfer function $HRTF_m(\theta)$ to a microphone in the same (e.g. left) quarter plane as the sound source in combination with a (stored) relative transfer function RTF(k, $\theta$) ($\Psi_{ms}(k, \theta)$) from the microphone in the same (e.g. left) quarter plane as the sound source to the microphone in the other (e.g. right) quarter plane. This is illustrated in FIG. 2A and FIG. 2B for the two front-facing quarter planes $\theta \in [-90°; 0°]$ (left quarter plane) and $\theta \in [0°, +90°]$ (right quarter plane), respectively. In FIG. 2A, the 'calculation path' is indicated by the bold, dashed arrows from the sound source (S) to the left microphone ($M_L$) (this arrow being denoted $HRTF_{left}(\theta)$ in FIG. 2A) and from the left ($M_L$) to the right microphone ($M_R$) (this arrow being denoted RTF (L→R) in FIG. 2A), and similarly in FIG. 2B from the sound source (S) to the right microphone ($M_R$) (this arrow being denoted $HRTF_{right}(\theta)$ in FIG. 2B) and from the right microphone ($M_R$) to the left microphone ($M_L$) (this arrow being denoted RTF(R→L) in FIG. 2B), respectively. The acoustic channel from the sound source (S) to the left microphone in FIG. 2A ($\theta \in [-90°; 0°]$) is indicated by aCHL and approximated by frequency independent acoustic channel parameters in the form of head related transfer function $HRTF_{left}(\theta)$ (represented by frequency independent attenuation $\alpha_{left}(\theta)$ and delay $D_{left}(\theta)$). Similarly, the acoustic channel from the sound source (S) to the right microphone in FIG. 2B ($\theta \in [0°, +90°]$) is indicated by aCHR and approximated by frequency independent acoustic channel parameters in the form of head related transfer function $HRTF_{right}(\theta)$ (represented by frequency independent attenuation $\alpha_{right}(\theta)$ and delay $D_{right}(\theta)$).

The acoustic channel parameters $HRTF_m(\theta)$ and relative transfer functions $RTF(\theta)$ are here (for simplicity) expressed in a common coordinate system having its center midway between the left and right ears of the user U (or between hearing devices $HD_L$, $HD_R$ or microphones $M_L$, $M_R$) as function of $\theta$. The parameters may be expressed in other coordinate systems, e.g. in different coordinate systems, e.g. relative to local reference directions ($REF\text{-}DIR_L$, $REF\text{-}DIR_R$), e.g. as a function of local angles $\theta_L$, $\theta_R$ (as long as there is a known relation between the individual coordinate systems).

The division of the calculation problem into two quarter planes and the assumption of a frequency independent acoustic channel from sound source to microphone in a given quarter plane (together with the use of previously determined relative transfer functions for acoustic signals from left to right microphones, which then need NOT be frequency independent) allows the use of inverse Fourier transform (e.g. IDFT) in the calculation of the maximum likelihood function (for determining the direction of arrival). Thereby, the calculations are simplified and thus particularly well suited for use in an electronic device having a limited power capacity, e.g. a hearing aid.

Figure 3A:
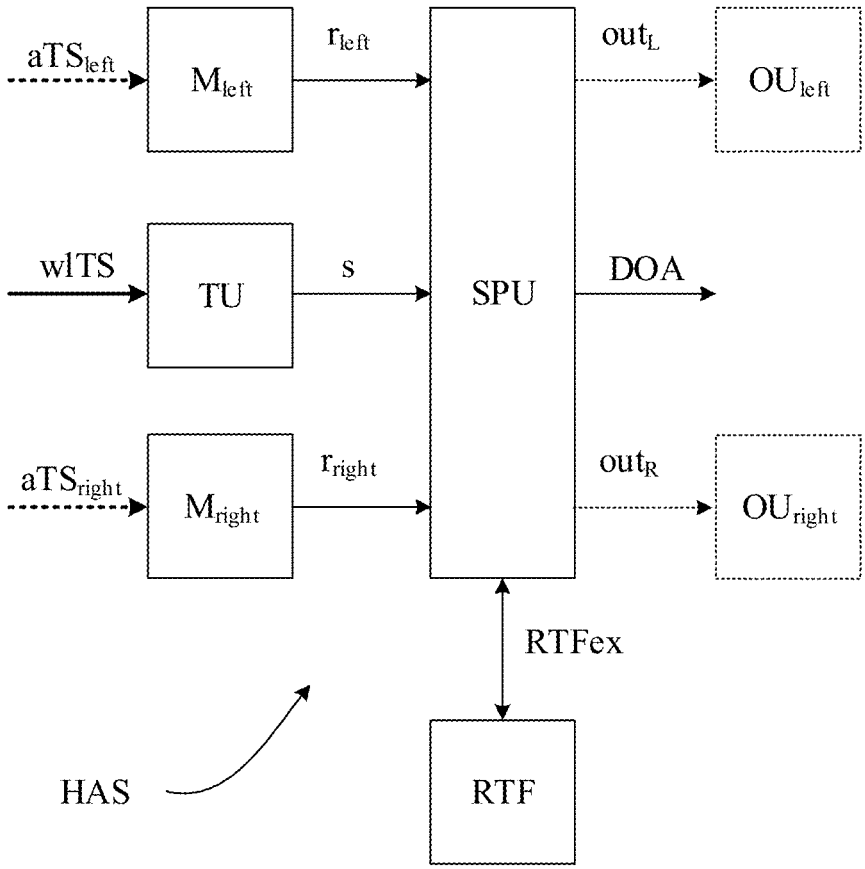
FIG. 3A shows a first embodiment of a hearing aid system according to the present disclosure.

FIG. 3A shows a first embodiment of a hearing aid system (HAS) according to the present disclosure. The hearing aid system (HAS) comprising at least one (here one) left input transducer ($M_{left}$, e.g. a microphone) for converting a received sound signal to an electric input signal ($r_{left}$), and at least one (here one) right input transducer ($M_{right}$, e.g. a microphone) for converting a received sound signal to an electric input signal ($r_{right}$). The input sound comprises a mixture of a target sound signal from a target sound source (S in FIG. 4A, 4B) and a possible additive noise sound signal (N in FIG. 4A, 4B) at the location of the at least one left and right input transducer, respectively. The hearing aid system further comprises a transceiver unit (TU) configured to receive a wirelessly transmitted version wITS of the target signal and providing an essentially noise-free (electric) target signal s. The hearing aid system further comprises a signal processing unit (SPU) operationally connected to left input transducer ($M_{left}$), to the right input transducer ($M_{right}$), and to the wireless transceiver unit (TU). The signal processing unit (SPU) is configured estimate a direction-of-arrival (cf. signal DOA) of the target sound signal relative to the user based on a) a signal model for a received sound signal $r_m$ at microphone $M_m$ (m=left, right) through an acoustic propagation channel from the target sound source to the microphone m when worn by the user; b) a maximum likelihood framework; and relative transfer functions representing direction-dependent filtering effects of the head and torso of the user in the form of direction-dependent acoustic transfer functions from a microphone on one side of the head, to a microphone on the other side of the head. In the embodiment of a hearing aid system (HAS) of FIG. 3A a database (RTF) of relative transfer functions accessible to the signal processing unit (SPU) via connection (or signal) RTFex is shown as a separate unit. It may e.g. be implemented as an external database that is accessible via a wired or wireless connection, e.g. via a network, e.g. the Internet. In an embodiment, the database RTF form part of the signal processing unit (SPU), e.g. implemented as a memory wherein the relative transfer functions are stored. In the embodiment of FIG. 3A, the hearing aid system (HAS) further comprises left and right output units $OU_{left}$ and $OU_{right}$, respectively, for presenting stimuli perceivable as sound to a user of the hearing aid system. The signal processing unit (SPU) is configured to provide left and right processed signals $out_L$ and $out_R$ to the left and right output units $OU_{left}$ and $OU_{right}$, respectively. In an embodiment the processed signals $out_L$ and $out_R$ comprises modified versions of the wirelessly received (essentially noise free) target signal s, wherein the modification comprises application of spatial cues corresponding to the estimated direction of arrival DoA (e.g. (in the time domain) by folding the target sound signal s with respective relative impulse response functions corresponding to the current, estimated DoA, or alternatively (in the time-frequency domain), to multiply the target sound signal S with relative transfer functions RFT corresponding to the current, estimated DoA, to provide left and right modified target signals $\hat{s}_L$ and $\hat{s}_R$, respectively). The processed signals $out_L$ and $out_R$ may e.g. comprise a weighted combination of the respective received sound signals $r_{left}$ and $r_{right}$, and the respective modified target signals $\hat{s}_L$ and $\hat{s}_R$, e.g. to provide that $out_L = w_{L1}\, r_{left} - w_{L2}\, \hat{s}_L$, and $out_R = w_{R1}\, r_{right} + w_{R2}\, \hat{s}_R$. In an embodiment, the weights are adapted to provide that the processed signals $out_L$ and $out_R$ are dominated by (such as equal to) the respective modified target signals $\hat{s}_L$ and $\hat{s}_R$.

Figure 3B:
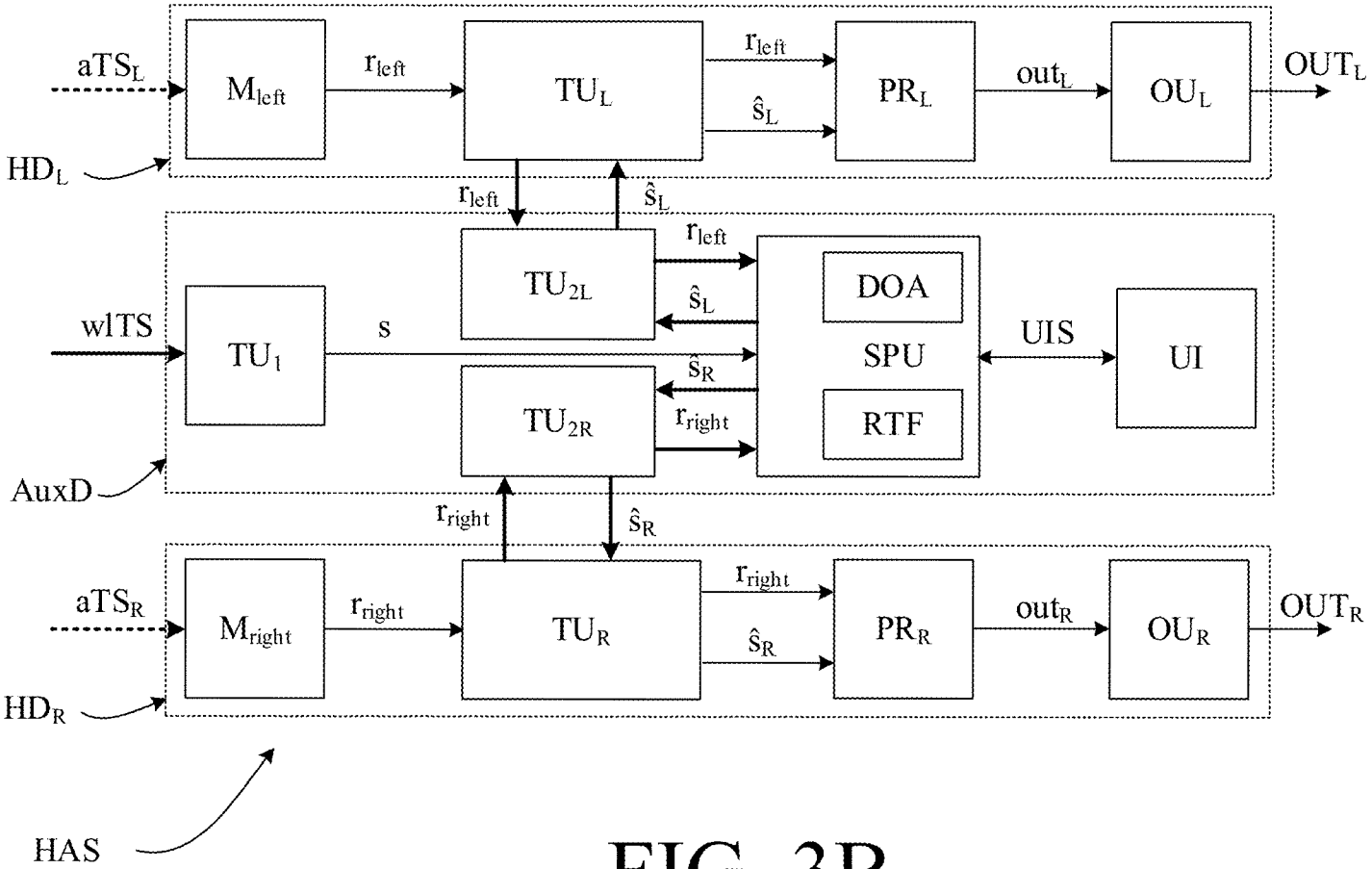
FIG. 3B shows a second embodiment of a hearing aid system comprising left and right hearing devices and an auxiliary device according to the present disclosure.

FIG. 3B shows a second embodiment of a hearing aid system (HAS) comprising left and right hearing devices ($HD_L$, $HD_R$) and an auxiliary device (AuxD) according to the present disclosure. The embodiment of FIG. 3B comprises the same functional elements as the embodiment of FIG. 3A, but is specifically partitioned in (at least) three physically separate devices. The left and right hearing devices ($HD_L$, $HD_R$), e.g. hearing aids, are adapted to be located at left and right ears, respectively, or to be fully or partially implanted in the head at the left and right ears of a user. The left and right hearing devices ($HD_L$, $HD_R$) comprises respective left and right microphones ($M_{left}$, $M_{right}$) for converting received sound signals to respective electric input signals ($r_{left}$, $r_{right}$). The left and right hearing devices ($HD_L$, $HD_R$) further comprises respective transceiver units ($TU_L$, $TU_R$) for exchanging audio signals and/or information/control signals with each other, respective processing units ($PR_L$, $PR_R$) for processing one or more input audio signals and providing one or more processed audio signals ($out_L$, $out_R$), and respective output units ($OU_L$, $OU_R$) for presenting respective processed audio signals ($out_L$, $out_R$) to the user as stimuli ($OUT_L$, $OUT_R$) perceivable as sound. The stimuli may e.g. be acoustic signals guided to the ear drum, vibration applied to the skull bone, or electric stimuli applied to electrodes of a cochlear implant. The auxiliary device (AuxD) comprises a first transceiver unit ($TU_l$) for receiving a wirelessly transmitted signal wITS, and providing an electric (essentially noise-free) version of the target signal s. The auxiliary device (AuxD) further comprises respective second left and right transceiver units ($TU_{2L}$, $TU_{2R}$) for exchanging audio signals and/or information/control signals with the left and right hearing device ($HD_L$, $HD_R$), respectively. The auxiliary device (AuxD) further comprises a signal processing unit (SPU) for estimating a direction of arrival (cf. subunit DOA) of the target sound signal relative to the user and, optionally, a user interface UI allowing a user to control functionality of the hearing aid system (HAS) and/or for presenting information regarding the functionality to the user. The left and right electric input signals ($r_{left}$, $r_{right}$) received by the respective microphones ($M_{left}$, $M_{right}$) of the left and right hearing devices ($HD_L$, $HD_R$), respectively, are transmitted to the auxiliary device (AuxD) via respective transceivers ($TU_L$, $TU_R$) in the left and right hearing devices ($HD_L$, $HD_R$) and respective second transceivers ($TU_{2L}$, $TU_{2R}$) in the auxiliary device (AuxD). The left and right electric input signals ($r_{left}$, $r_{right}$) as received in the auxiliary device (AuxD) are fed to the signal processing unit together with the target signal s as received by first transceiver ($TU_l$) of the auxiliary device. Based thereon (and on a propagation model and a database of relative transfer functions RTF(k, θ)), the signal processing unit estimates a direction of arrival (DOA) of the target signal, and applies respective head relative related transfer functions (or impulse responses) to the wirelessly received version of the target signal s to provide modified left and right target signals $\hat{s}_L$, $\hat{s}_R$, which are transmitted to the respective left and right hearing devices via the respective transceivers. In the left and right hearing devices ($HD_L$, $HD_R$), the modified left and right target signals $\hat{s}_L$, $\hat{s}_R$ are fed to respective processing units ($PR_L$, $PR_R$) together with the respective left and right electric input signals ($r_{left}$, $r_{right}$). The processing units ($PR_L$, $PR_R$) provides respective left and right processed audio signals ($out_L$, $out_R$), e.g. frequency shaped according to a user's needs, and/or mixed in an appropriate ratio to ensure perception of the (clean) target signal ($\hat{s}_L$, $\hat{s}_R$) with directional cues reflecting an estimated direction of arrival, as well as giving a sense of the environment sound (via signals ($r_{left}$, $r_{right}$)).

Figure 6A:
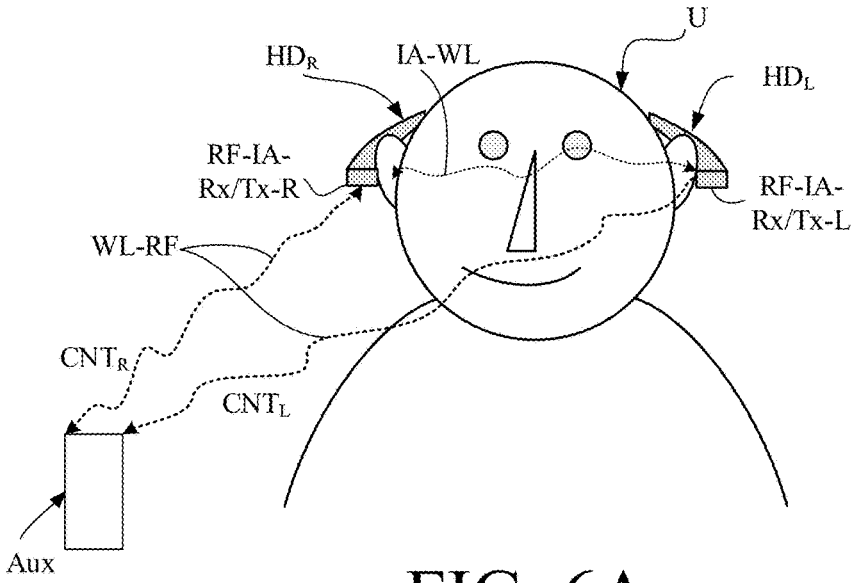
FIG. 6A illustrates an embodiment of a hearing aid system according to the present disclosure comprising left and right hearing devices in communication with an auxiliary device.
Figure 6B:
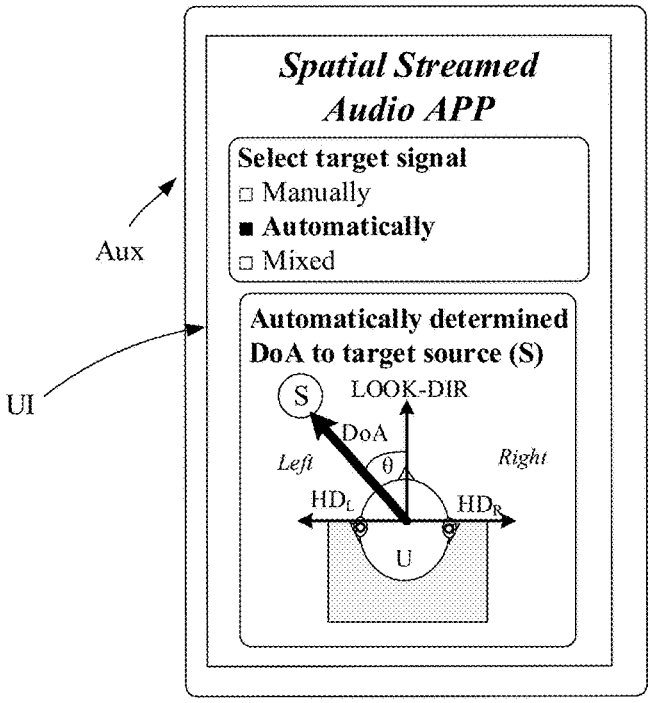
FIG. 6B shows the auxiliary device of FIG. 6A comprising a user interface of the hearing aid system, e.g. implementing a remote control for controlling functionality of the hearing aid system.

The auxiliary device further comprises a user interface (UI) allowing a user to influence a mode of operation of the hearing aid system as well as for presenting information to the user (via signal UIS), cf. FIG. 6B. The auxiliary device may e.g. be implemented as a (part of a) communication device, e.g. a cellular telephone (e.g. a smartphone) or a personal digital assistant (e.g. a portable, e.g. wearable, computer, e.g. a implemented as a tablet computer or a watch, or similar device).

In the embodiment of FIG. 3B the first and second transceivers of the auxiliary device (AuxD) are shown as separate units ($TU_l$, $TU_{2L}$, $TU_{2R}$). The transceivers may be implemented as two or one transceiver according to the application in question (e.g. depending on the nature (near-field, far-field) of the wireless links and/or the modulation scheme or protocol (proprietary or standardized, NFC, Bluetooth, ZigBee, etc.).

Figure 3C:
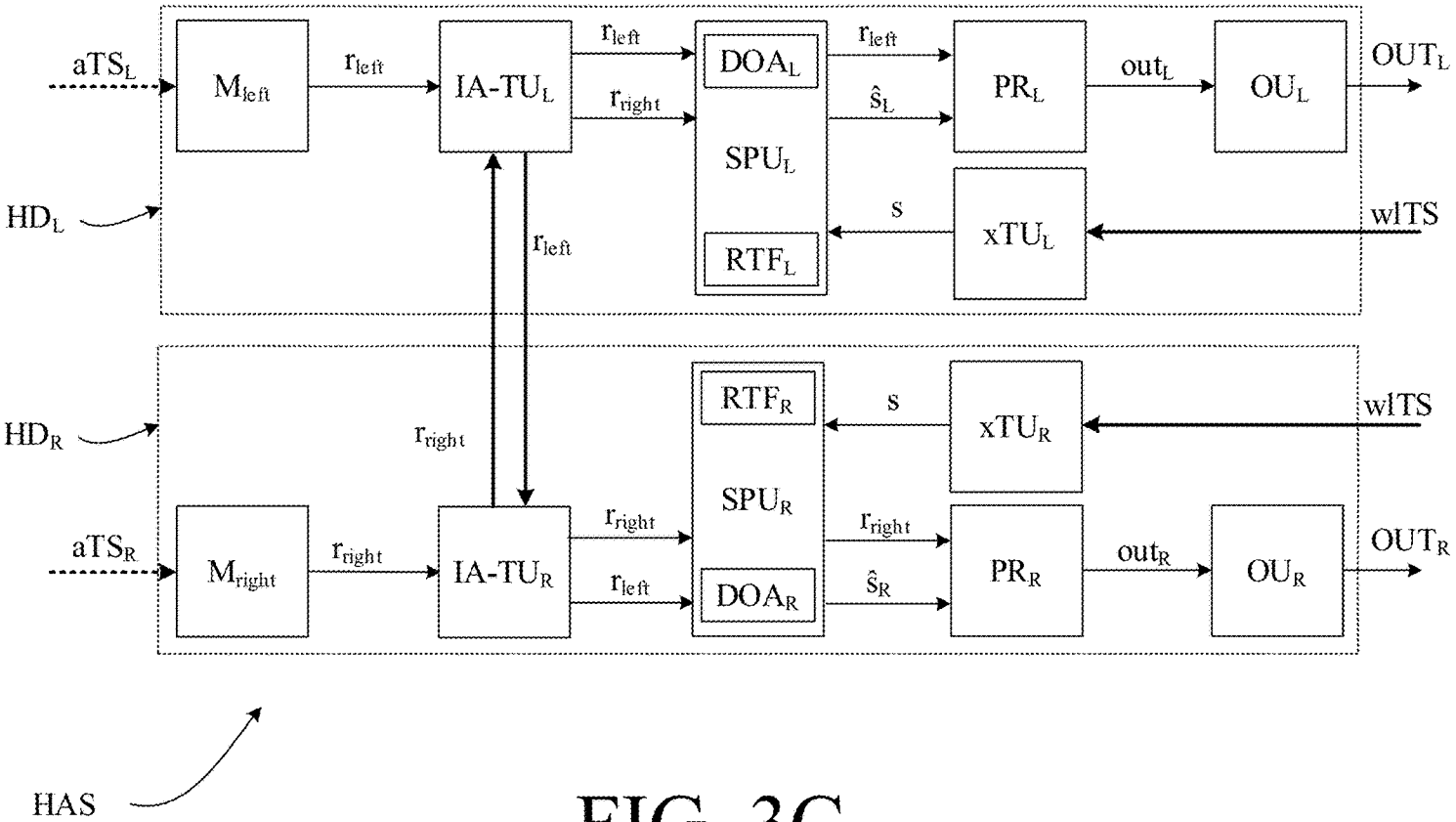
FIG. 3C shows a third embodiment of a hearing aid system comprising left and right hearing devices according to the present disclosure.

FIG. 3C shows a third embodiment of a hearing aid system (HAS) comprising left and right hearing devices according to the present disclosure. The embodiment of FIG. 3C comprises the same functional elements as the embodiment of FIG. 3B, but is specifically partitioned in two physically separate devices, left and right hearing devices, e.g. hearing aids ($HD_L$, $HD_R$). In other words, the processing which is performed in the auxiliary device (AuxD) in the embodiment of FIG. 3B is performed in each of the hearing devices ($HD_L$, $HD_R$) in the embodiment of FIG. 3C. The user interface may e.g. still be implemented in an auxiliary device, so that presentation of information and control of functionality can be performed via the auxiliary device (cf. e.g. FIG. 6B). In the embodiment of FIG. 3C, only the respective received electrical signals ($r_{left}$, $r_{right}$) from respective microphones ($M_{left}$, $M_{right}$) are exchanged between the left and right hearing devices (via left and right interaural transceivers IA-$TU_L$ and IA-$TU_R$, respectively). On the other hand, separate wireless transceivers ($xTU_L$, $xTU_R$) for receiving the (essentially noise free version of the) target signal s are included in the left and right hearing devices ($HD_L$, $HD_R$). The onboard processing may provide an advantage in the functionality of the hearing aid system (e.g. reduced latency) but may come at the cost of an increased power consumption of the hearing devices ($HD_L$, $HD_R$). Using onboard left and right databases of relative transfer functions (RTF), cf. sub-units $RTF_L$, $RTF_R$, and left and right estimates of the direction of arrival of the target signal s, cf. sub-units $DOA_L$, $DOA_R$, the individual signal processing units ($SPU_L$, $SPU_R$) provides modified left and right target signals $\hat{s}_L$, $\hat{s}_R$, respectively, which are fed to respective processing units ($PR_L$, $PR_R$) together with the respective left and right electric input signals ($r_{left}$, $r_{right}$), as described in connection with FIG. 3B. The signal processing units ($SPU_L$, $SPU_R$) and the processing units ($PR_L$, $PR_R$) of the left and right hearing devices ($HD_L$, $HD_R$), respectively, are shown as separate units but may of course be implemented as one functional signal processing unit that provides (mixed) processed audio signals ($out_L$, $out_R$), e.g. a weighted combination based on the left and right (acoustically) received electric input signals ($r_{left}$, $r_{right}$) and the modified left and right (wirelessly received) target signals $\hat{s}_L$, $\hat{s}_R$, respectively. In an embodiment, the estimated direction of arrival ($DOA_L$, $DOA_R$) of the left and right hearing devices are exchanged between the hearing devices and used in the respective signal processing units ($SPU_L$, $SPU_R$) to influence an estimate of a resulting DoA, which may used in the determination of respective resulting modified target signals $\hat{s}_L\hat{s}_R$.

A user interface may be included in the embodiment of FIG. 3C, e.g. in a separate device as shown in FIG. 6A, 6B.

Figure 4A:
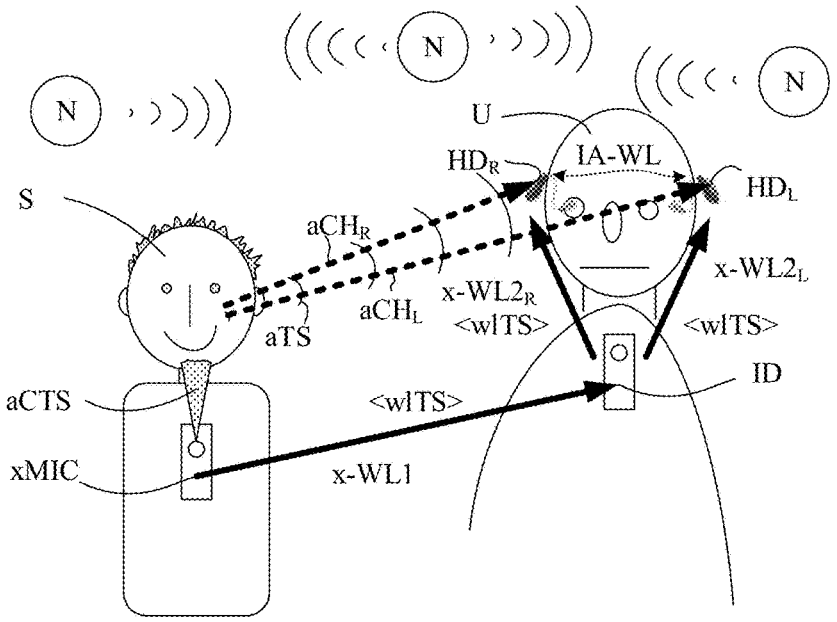
FIG. 4A shows a hearing aid system comprising a partner microphone unit (PMIC), a pair of hearing devices ($HD_l$, $HD_r$) and an (intermediate) auxiliary device (AD).
Figure 4B:
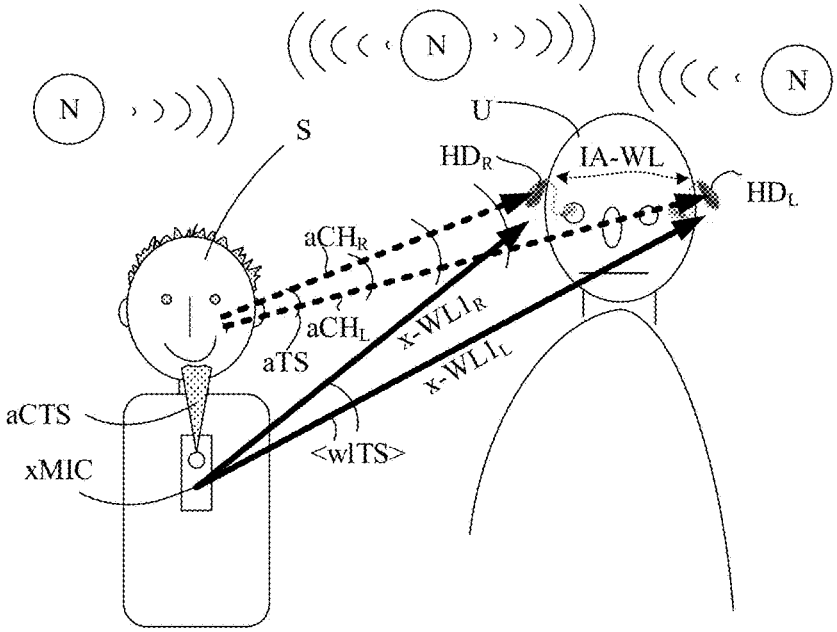
FIG. 4B shows a hearing system comprising a partner microphone unit (PMIC), and a pair of hearing devices ($HD_l$, $HD_r$).

FIGS. 4A and 4B shows two exemplary use scenarios of a hearing aid system according to the present disclosure comprising an external microphone unit (xMIC) and a pair of (left and right) hearing devices ($HD_L$, $HD_R$). The left and right hearing devices (e.g. forming part of a binaural hearing aid system) are worn by a user (U) at left and right ears, respectively. The external microphone is e.g. worn by a communication partner or a speaker (S), whom the user wishes to engage in discussion with and/or listen to. The external microphone unit (xMIC) may be a unit worn by a person (S) that at a given time only intends to communicate with the user (U). In an embodiment, the user U and the person wearing the external microphone (S) are within acoustic reach of each other (allowing sound from the communication partner to reach microphones of the hearing aid system worn by the user). In a particular scenario, the external microphone unit (xMIC) may form part of a larger system (e.g. a public address system), where the speaker's voice is transmitted to the user (e.g. wirelessly broadcast) and possible other users of hearing devices, and possibly acoustically broadcast via loudspeakers as well (thereby providing the target signal is received wirelessly as well as acoustically at the location of the user). The external microphone unit may be used in either situation. In an embodiment, the external microphone unit (xMIC) comprises a multi-input microphone system configured to focus on the target sound source (the voice of the wearer) and hence direct its sensitivity towards its wearer's mouth, cf. (ideally) cone-formed beam (denoted aCTS in FIG. 4A, 4B)) from the external microphone unit to the mouth of the speaker (S). The (clean) target signal (aCTS) thus picked up is transmitted to the left and right hearing devices ($HD_L$, $HD_R$) worn by the user (U). FIG. 4A and FIG. 4B illustrate two possible scenarios of the (wireless) transmission path from the partner microphone unit to the left and right hearing devices ($HD_L$, $HD_R$). In embodiments of the present disclosure, the hearing system is configured to exchange information between the left and right hearing devices ($HD_L$, $HD_R$) (such information may e.g. include the microphone signals picked up by the respective hearing devices and/or direction-of-arrival information, etc. (see FIG. 2)), e.g. via an inter-aural wireless link (cf. IA-WL in FIG. 4A, 4B). A number of competing sound sources (here three, all denoted noise 'N' in FIGS. 4A and 4B) are acoustically mixed with (added to) the acoustically propagated target signal (aTS), cf. acoustic propagation channels ($aCH_L$, $aCH_R$, cf. dashed bold arrows in FIG. 4A, 4B) from the source (S) (person wearing the external microphone) to (microphones of) the left and right hearing devices ($HD_L$, $HD_R$), worn by the user (U)).

FIG. 4A shows a hearing aid system comprising an external microphone (xMIC), a pair of hearing devices ($HD_l$, $HD_r$) and intermediate device (ID). The solid arrows indicate respective audio links (x-WL1, $xWL\mathbf{2}_L$, $xWL\mathbf{2}_R$) for transmitting an audio signal (denoted <wlTS> in FIG. 4A) containing the voice of the person (U) wearing the external microphone unit from the external microphone unit (xMIC) to the intermediary device (ID) and on to the left and right hearing devices ($HD_L$, $HD_R$), respectively. The intermediate device (ID) may be a mere relay station or may contain various functionality, e.g. provide a translation from one link protocol or technology to another (e.g. from a far-field transmission technology, e.g. based on Bluetooth (e.g. Bluetooth Low Energy) to a near-field transmission technology (e.g. inductive), e.g. based on NFC or a proprietary protocol). Alternatively, the two links may be based on the same transmission technology, e.g. Bluetooth or similar standardized or proprietary scheme. Similarly, the optional inter-aural wireless link (IA-WL) may be based on far-field or near-field communication technology.

FIG. 4B shows a hearing aid system comprising an external microphone unit (xMIC), and a pair of hearing devices ($HD_L$, $HD_R$). The solid arrows indicate the direct path of an audio signal (<wlTS>) containing the voice of the person (S) wearing the external microphone unit (xMIC) from the external microphone unit to the left and right hearing devices ($HD_L$, $HD_R$). The hearing aid system is thus configured to allow respective audio links ($xWL\mathbf{1}_L$, $xWL\mathbf{1}_R$) to be established between the external microphone unit (xMIC) and the left and right hearing devices ($HD_L$, $HD_R$), and optionally between the left and right hearing devices ($HD_L$, $HD_R$) via an inter-aural wireless link (IA-WL). In an embodiment (or temporarily), only one of the audio links ($xWL\mathbf{1}_L$, $xWL\mathbf{1}_R$) is available, in which case the audio signal may be relayed to the un-connected hearing device via the inter-aural link. The external microphone unit (xMIC) comprises antenna and transceiver circuitry to allow (at least) the transmission of audio signals (<wlTS>), and the left and right hearing devices ($HD_L$, $HD_R$) comprises antenna and transceiver circuitry to allow (at least) the reception of audio signals (<wlTS>) from the external microphone unit (xMIC). The link(s) may e.g. be based on far-field communication, e.g. according to a standardized (e.g. Bluetooth, e.g. Bluetooth Low Energy) or (e.g. similar) proprietary scheme. Alternatively, the inter-aural wireless link (IA-WL) may be based on near-field transmission technology (e.g. inductive), e.g. based on NFC or a proprietary protocol.

Figure 5:
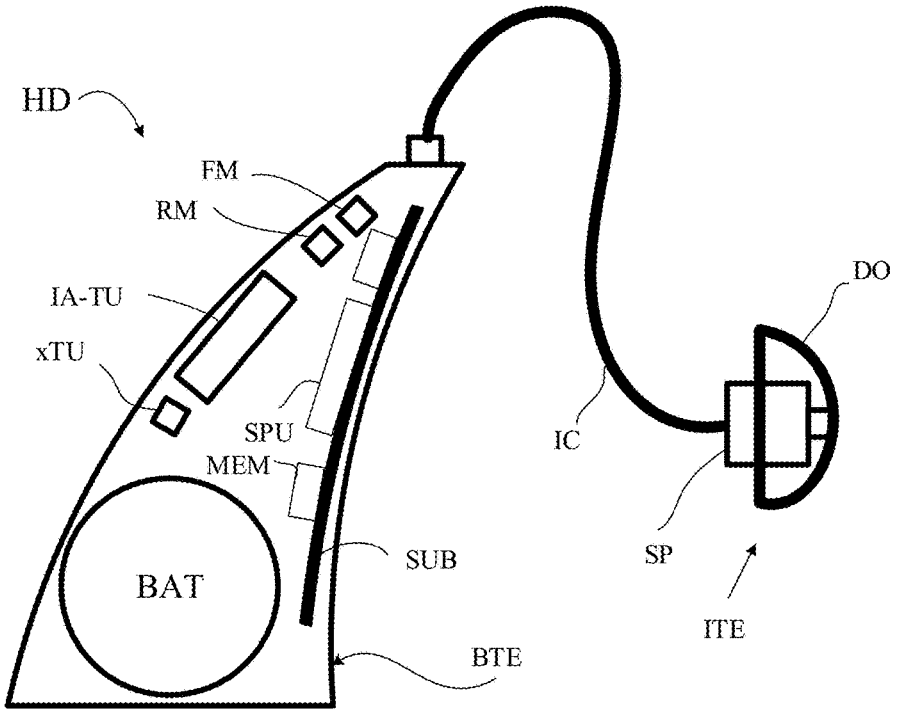
FIG. 5 shows an exemplary hearing device which may form part of a hearing system according to the present disclosure.

FIG. 5 shows an exemplary hearing device, which may form part of a hearing system according to the present disclosure. The hearing device (HD) shown in FIG. 5, e.g. a hearing aid, is of a particular style (sometimes termed receiver-in-the ear, or RITE, style) comprising a BTE-part (BTE) adapted for being located at or behind an ear of a user and an ITE-part (ITE) adapted for being located in or at an ear canal of a user's ear and comprising a receiver (loudspeaker, SP). The BTE-part and the ITE-part are connected (e.g. electrically connected) by a connecting element (IC).

In the embodiment of a hearing device (HD) in FIG. 5, e.g. a hearing aid, the BTE part comprises two input transducers (e.g. microphones) (FM, RM, corresponding to the front ($FM_x$) and rear ($RM_x$) microphones, respectively, of FIG. 1B) each for providing an electric input audio signal representative of an input sound signal (e.g. a noisy version of a target signal). In another embodiment, the hearing device comprise only one input transducer (e.g. one microphone), as e.g. indicated in FIG. 2A, 2B. In still another embodiment the hearing device comprise three or more input transducers (e.g. microphones). The hearing device of FIG. 5 further comprises two wireless transceivers (IA-TU, xTU) for availing reception and/or transmission of respective audio and/or information or control signals. In an embodiment, xTU is configured to receive an essentially noise-free version of the target signal from a target sound source, and IA-TU is configured to transmit or receive audio signals (e.g. microphone signals, or (e.g. band-limited) parts thereof) and/or to transmit or receive information (e.g. related to the localization of the target sound source, e.g. DoA) from a contralateral hearing device of a binaural hearing system, e.g. a binaural hearing aid system or from an auxiliary device. The hearing device (HD) comprises a substrate SUB whereon a number of electronic components are mounted, including a memory (MEM) storing relative transfer functions RTF(k, θ) from a microphone of the hearing device to a microphone of contralateral hearing device. The BTE-part further comprises a configurable signal processing unit (SPU) adapted to access the memory (MEM) and for selecting and processing one or more of the electric input audio signals and/or one or more of the directly received auxiliary audio input signals, based on a current parameter setting (and/or on inputs from a user interface). The configurable signal processing unit (SPU) provides an enhanced audio signal, which may be presented to a user or further processed or transmitted to another device as the case may be.

The hearing device (HD) further comprises an output unit (e.g. an output transducer or electrodes of a cochlear implant) providing an enhanced output signal as stimuli perceivable by the user as sound based on said enhanced audio signal or a signal derived therefrom In the embodiment of a hearing device in FIG. 5, the ITE part comprises the output unit in the form of a loudspeaker (receiver) (SP) for converting a signal to an acoustic signal. The ITE-part further comprises a guiding element, e.g. a dome, (DO) for guiding and positioning the ITE-part in the ear canal of the user.

The hearing device (HA) exemplified in FIG. 5 is a portable device and further comprises a battery (BAT), e.g. a rechargeable battery, for energizing electronic components of the BTE- and ITE-parts. In an embodiment, the hearing device (HA) comprises a battery status detector providing a control signal indicating a current status of the battery (e.g. its battery voltage, or a rest-capacity).

In an embodiment, the hearing device, e.g. a hearing aid (e.g. the signal processing unit), is adapted to provide a frequency dependent gain and/or a level dependent compression and/or a transposition (with or without frequency compression) of one or more source frequency ranges to one or more target frequency ranges, e.g. to compensate for a hearing impairment of a user.

A hearing aid system according to the present disclosure may e.g. comprise left and right hearing devices as shown in FIG. 5.

FIG. 6A illustrates an embodiment of a hearing aid system according to the present disclosure. The hearing aid system comprises left and right hearing devices in communication with an auxiliary device, e.g. a remote control device, e.g. a communication device, such as a cellular telephone or similar device capable of establishing a communication link to one or both of the left and right hearing devices.

FIG. 6A, 6B shows an application scenario comprising an embodiment of a binaural hearing aid system comprising first and second hearing devices ($HD_R$, $HD_L$) and an auxiliary device (Aux) according to the present disclosure. The auxiliary device (Aux) comprises a cellular telephone, e.g. a SmartPhone. In the embodiment of FIG. 6A, the hearing instruments and the auxiliary device are configured to establish wireless links (WL-RF) between them, e.g. in the form of digital transmission links according to the Bluetooth standard (e.g. Bluetooth Low Energy). The links may alternatively be implemented in any other convenient wireless and/or wired manner, and according to any appropriate modulation type or transmission standard, possibly different for different audio sources. The auxiliary device (e.g. a SmartPhone) of FIG. 6A, 6B comprises a user interface (UI) providing the function of a remote control of the hearing aid system, e.g. for changing program or operating parameters (e.g. volume) in the hearing device(s), etc. The user interface (UI) of FIG. 6B illustrates an APP (denoted 'Spatial Streamed Audio APP') for selecting a mode of operation of the hearing system where spatial cues are added to audio signals streamed to the left and right hearing devices ($HD_L$, $HD_R$). The APP allows a user to select a manual (Manually), and automatic (Automatically) or a mixed (Mixed) mode. In the screen of FIG. 6B, the automatic mode of operation has been selected as indicated by the left solid 'tick-box' and the bold face indication Automatically. In this mode, the direction of arrival of a target sound source is automatically determined (as described in the present disclosure) and the result is displayed in the screen by circular symbol denoted S and bold arrow denoted DoA schematically shown relative to the head of the user to reflect its estimated location. This is indicated by the text Automatically determined DoA to target source S in the lower part of the screen in FIG. 6B. In a manual mode (Manually), an estimate of the location of the target sound source may be indicated by the user via the user interface (UI), e.g. by moving a sound source symbol (S) to an estimated location on the screen relative to the user's head. In a mixed mode (Mixed), the user may indicate a rough direction to the target sound source (e.g. the quarter plane wherein the target sound source is located), and then the specific direction of arrival is determined according to the present disclosure (whereby the calculations are simplified by excluding a part of the possible space).

In an embodiment, the calculations of the direction of arrival are performed in the auxiliary device (cf. e.g. FIG. 3B). In another embodiment, the calculations of the direction of arrival are performed in the left and/or right hearing devices (cf. e.g. FIG. 3C). In the latter case the system is configured to exchange the data defining the direction of arrival of the target sound signal between the auxiliary device and the hearing device(s).

In an embodiment, the hearing aid system is configured to apply appropriate transfer functions to the wirelessly received (streamed) target audio signal to reflect the direction of arrival determined according to the present disclosure. This has the advantage of providing a sensation of the spatial origin of the streamed signal to the user.

The hearing device ($HD_L$, $HD_R$) are shown in FIG. 6A as devices mounted at the ear (behind the ear) of a user U. Other styles may be used, e.g. located completely in the ear (e.g. in the ear canal), fully or partly implanted in the head, etc. Each of the hearing instruments comprise a wireless transceiver to establish an interaural wireless link (IA-WL) between the hearing devices, here e.g. based on inductive communication. Each of the hearing devices further comprises a transceiver for establishing a wireless link (WL-RF, e.g. based on radiated fields (RF)) to the auxiliary device (Aux), at least for receiving and/or transmitting signals ($CNT_R$, $CNT_L$), e.g. control signals, e.g. information signals (e.g. DoA), e.g. including audio signals. The transceivers are indicated by RF-IA-Rx/Tx-R and RF-IA-Rx/Tx-L in the right and left hearing devices, respectively.

Figure 7:
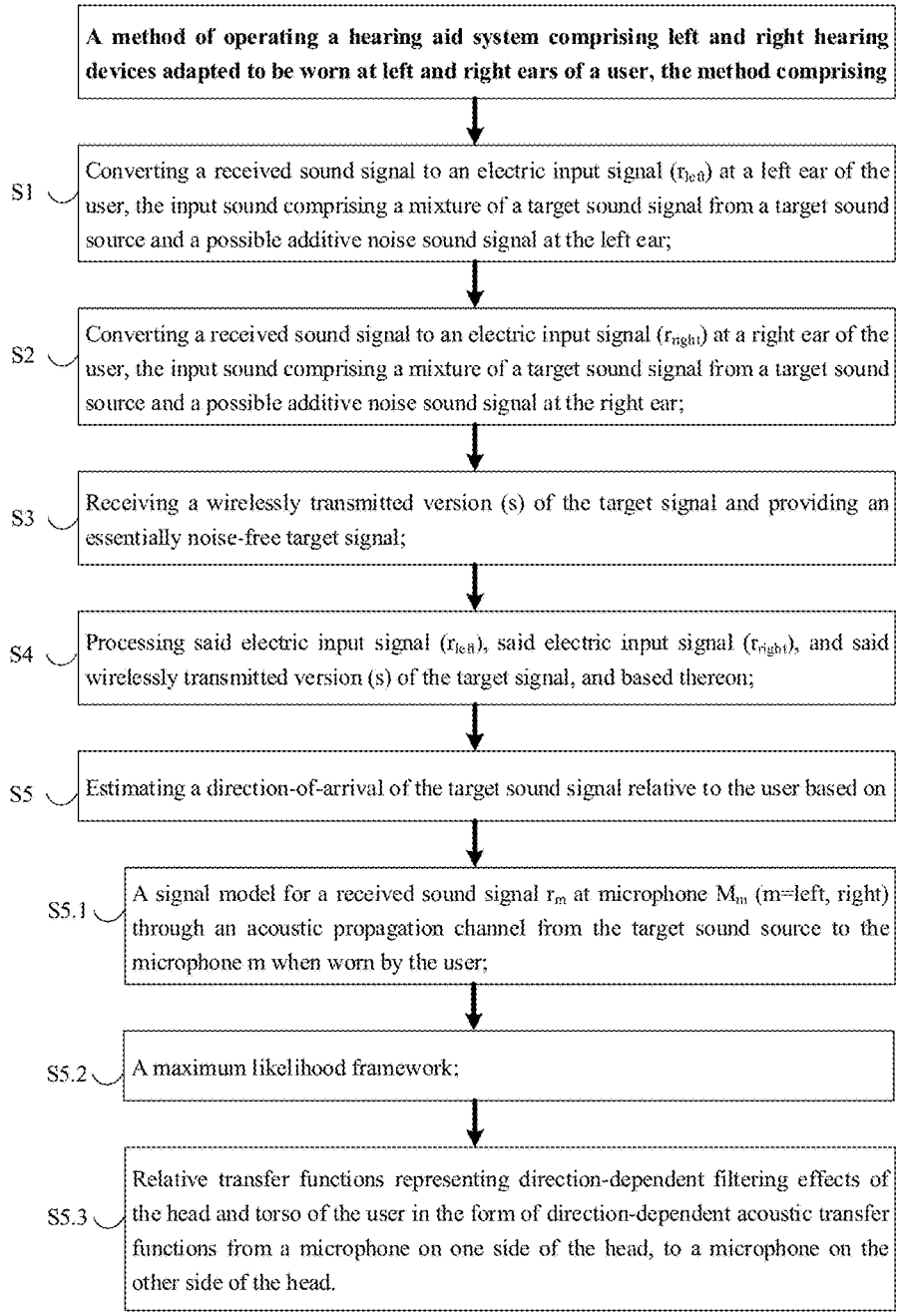
FIG. 7 shows a flow diagram for an embodiment of a method according to the present disclosure.

FIG. 7 shows a flow diagram for an embodiment of a method according to the present disclosure. FIG. 7 illustrates a method of operating a hearing aid system comprising left and right hearing devices adapted to be worn at left and right ears of a user according to the present disclosure The method comprises S1. converting a received sound signal to an electric input signal ($r_{left}$) at a left ear of the user, the input sound comprising a mixture of a target sound signal from a target sound source and a possible additive noise sound signal at the left ear;

S2. converting a received sound signal to an electric input signal ($r_{right}$) at a right ear of the user, the input sound comprising a mixture of a target sound signal from a target sound source and a possible additive noise sound signal at the right ear;

S3. receiving a wirelessly transmitted version (s) of the target signal and providing an essentially noise-free target signal;

S4. processing said electric input signal ($r_{left}$), said electric input signal ($r_{right}$), and said wirelessly transmitted version (s) of the target signal, and based thereon;

S5. estimating a direction-of-arrival of the target sound signal relative to the user based on

- S5.1. a signal model for a received sound signal $r_m$ at microphone $M_m$ (m=left, right) through an acoustic propagation channel from the target sound source to the microphone m when worn by the user;
- S5.2. a maximum likelihood framework;
- S5.3. relative transfer functions representing direction-dependent filtering effects of the head and torso of the user in the form of direction-dependent acoustic transfer functions from a microphone on one side of the head, to a microphone on the other side of the head.

In the outline presented above, two input transducers (e.g. microphones), one at each ear of a user, are used. For the person skilled in the art, it is however, relatively straightforward to generalize the expressions above to the situation, where the positions of several wireless input transducers (e.g. microphones) must be estimated jointly.

Furthermore, it is relatively straightforward to modify the proposed method to take into account knowledge on the typical physical movements of sound sources. For example, the speed with which target sound sources change their position relative to the microphones of the hearing aids is limited: first, because sound sources (typical humans) maximally move by a few m/s. Secondly, the speed with which the hearing aid user can turn his head is limited (since we are interested in estimating the DoA of target sound sources relative to the hearing aid microphones, which are mounted on the head of a user, head movements will change the relative positions of target sound sources). One might build such prior knowledge into the proposed method, e.g., by replacing the evaluation of RTS for all possible directions in the range [−90°-90°] to a smaller range for directions close to an earlier, reliable DoA estimate.

The DoA estimation problem is solved in a maximum likelihood framework. Other methods may be used though as the case may be.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[1]: "Informed TDoA-based Direction of Arrival Estimation for Hearing Aid Applications," M. Farmani, M. S. Pedersen, Z.-H. Tan, and J. Jensen, 2015 IEEE Global Conference on Signal and Information Processing (GlobalSIP), 2015, pp. 953-957.

[2]: "Informed Direction of Arrival Estimation Using a Spherical-Head Model for Hearing Aid Applications," M. Farmani, M. S. Pedersen, Z.-H. Tan, and J. Jensen, 2016 IEEE International Conference on Acoustics, Speech and Signal Processing ICASSP 2016, pp. 360-364.

[3]: "Informed Sound Source Localization using Relative Transfer Functions for Hearing Aid Applications", M. Farmani, M. S. Pedersen, Z.-H. Tan, and J. Jensen, submitted to IEEE/ACM Transactions on Audio, Speech and Language Processing, Vol. 25(3), March 2017, pp. 611-623.

The invention claimed is:

1. A hearing aid system comprising left and right hearing devices adapted to be worn at left and right ears of a user, the left hearing device comprising at least one left input transducer ($M_{left}$) for converting received sound signal to an electric input signal ($r_{left}$), the input sound comprising a mixture of a target sound signal from a target sound source and a possible additive noise sound signal at the location of the at least one left input transducer;

the right hearing device comprising at least one right input transducer ($M_{right}$) for converting received sound signal to an electric input signal ($r_{right}$), the input sound comprising a mixture of a target sound signal from a target sound source and a possible additive noise sound signal at the location of the at least one right input transducer;

the hearing aid system further comprising a first transceiver unit configured to receive a wirelessly transmitted version of the target signal and providing an essentially noise-free target signal;

a signal processing unit connected to said at least one left input transducer, to said at least one right input transducer, and to said wireless transceiver unit, the signal processing unit being configured to be used for estimating a direction-of-arrival of the target sound signal relative to the user based on a signal model for a received sound signal $r_m$ at microphone $M_m$ (m=left, right) through an acoustic propagation channel from the target sound source to the microphone m when worn by the user;

a maximum likelihood framework;

relative transfer functions representing direction-dependent filtering effects of the head and torso of the user in the form of direction-dependent acoustic transfer functions from a microphone on one side of the head, to a microphone on the other side of the head.

2. A hearing aid system according to claim 1 configured to provide that the signal processing unit has access to a database of relative transfer functions $\Psi_{ms}$ for different directions (θ) relative to the user.

3. A hearing aid system according to claim 2 wherein the database of relative transfer functions $\Psi_{ms}$ is stored in a memory of the hearing aid system.

4. A hearing aid system according to claim 1 wherein the signal model is given by the following expression $$r_m(n)=s(n)*h_m(n,\theta)+v_m(n),\ (m=\{\text{left,right}\}\text{ or }\{1,2\}),$$

where s is the essentially noise-free target signal emitted by the target sound source, $h_m$ is the acoustic channel impulse response between the target sound source and microphone m, and $v_m$ is an additive noise component, θ is an angle of a direction-of-arrival of the target sound source relative to a reference direction defined by the user and/or by the location of the first and second hearing devices at the ears of the user, n is a discrete time index, and * is the convolution operator.

5. A hearing aid system according to claim 1 configured to provide that said left and right hearing devices, and said signal processing unit are located in or constituted by three physically separate devices.

6. A hearing aid system according to claim 1 configured to provide that each of said left and right hearing devices comprise a signal processing unit, and to provide that information signals, e.g. audio signals, or parts thereof, can be exchanged between the left and right hearing devices.

7. A hearing aid system according to claim 1 comprising a time to time-frequency conversion unit for converting an electric input signal in the time domain into a representation of the electric input signal in the time-frequency domain, providing the electric input signal at each time instance 1 in a number for frequency bins k, k=1, 2, . . . , N.

8. A hearing aid system according to claim 1 wherein the signal processing unit is configured to provide a maximum-likelihood estimate of the direction of arrival θ of the target sound signal.

9. A hearing aid system according to claim 1 wherein the sound propagation model of an acoustic propagation channel from the target sound source to the hearing device when worn by the user comprises a signal model defined by $$R_m(l,k)=S(l,k)H_m(k,\theta)+V_m(l,k)$$

where $R_m(l, k)$ is a time-frequency representation of the noisy target signal, S(l, k) is a time-frequency representation of the noise-free target signal, $H_m(k, \theta)$ is a frequency transfer function of the acoustic propagation channel from the target sound source to the respective input transducers of the hearing devices, and $V_m(l, k)$ is a time-frequency representation of the additive noise.

10. A hearing aid system according to claim 1 wherein the signal processing unit is configured to provide a maximum-likelihood estimate of the direction of arrival θ of the target sound signal by finding the value of θ, for which the log likelihood function is maximum, and wherein the expression for the log likelihood function is adapted to allow a calculation of individual values of the log likelihood function for different values of the direction-of-arrival (θ) using the inverse Fourier transform, e.g. IDFT, such as IFFT.

11. A hearing aid system according to claim 1 wherein the at least one input transducer of the left hearing devices is equal to one, e.g. a left microphone, and wherein the at least one input transducer of the right hearing devices is equal to one, e.g. a right microphone.

12. A hearing aid system according to claim 2 wherein the database of relative transfer functions $\Psi_{ms}$ for different directions (θ) relative to the user are frequency dependent.

13. A hearing aid system according to claim 1 configured to approximate the acoustic transfer function from a target sound source in the front-left quarter plane (−90°-0° to the at least one left input transducer and the acoustic transfer function from a target sound source in the front-right quarter plane (0°-+90°) to at least one right input transducer as a frequency-independent attenuation and a frequency-independent delay.

14. A hearing aid system according to claim 1 configured to evaluate the log likelihood function L for relative transfer functions $\Psi_{ms}$ corresponding to the directions on the left side of the head (θ∈ [−90°; 0°]), where the acoustic channel parameters of a left input transducer, e.g. a left microphone, are assumed to be frequency independent.

15. A hearing aid system according to claim 1 configured to evaluate the log likelihood function L for relative transfer functions $\Psi_{ms}$ corresponding to the directions on the right side of the head (θ ∈ [0°; +90°]), where the acoustic channel parameters of a right input transducer, e.g. a right microphone, are assumed to be frequency independent.

16. A hearing aid system according to claim 1 wherein at least one of the left and right hearing devices comprises a hearing aid, a headset, an earphone, an ear protection device or a combination thereof.

17. A hearing aid system according to claim 1 comprising an auxiliary device, the hearing aid system being adapted to establish a communication link between the hearing devices and the auxiliary device to provide that information can be exchanged or forwarded from one to the other.

18. A hearing aid system according to claim 16 comprising a non-transitory application, termed an APP, comprising executable instructions configured to be executed on the auxiliary device to implement a user interface for the hearing aid system.

19. A method of operating a hearing aid system comprising left and right hearing devices adapted to be worn at left and right ears of a user, the method comprising converting a received sound signal to an electric input signal ($r_{left}$) at a left ear of the user, the input sound comprising a mixture of a target sound signal from a target sound source and a possible additive noise sound signal at the left ear;

converting a received sound signal to an electric input signal ($r_{right}$) at a right ear of the user, the input sound comprising a mixture of a target sound signal from a target sound source and a possible additive noise sound signal at the right ear;

receiving a wirelessly transmitted version (s) of the target signal and providing an essentially noise-free target signal;

processing said electric input signal ($r_{left}$), said electric input signal ($r_{right}$), and said wirelessly transmitted version (s) of the target signal, and based thereon estimating a direction-of-arrival of the target sound signal relative to the user based on a signal model for a received sound signal $r_m$ at microphone $M_m$ (m=left, right) through an acoustic propagation channel from the target sound source to the microphone m when worn by the user;

a maximum likelihood framework;

relative transfer functions representing direction-dependent filtering effects of the head and torso of the user in the form of direction-dependent dependent acoustic transfer functions from a microphone on one side of the head, to a microphone on the other side of the head.

20. A data processing system comprising a processor and program code means for causing the processor to perform the steps of the method of claim 17.

* * * * *